US005424808A

United States Patent [19]

Maekawa et al.

[11] Patent Number: 5,424,808

[45] Date of Patent: Jun. 13, 1995

[54] CONTROL APPARATUS FOR COPYING MACHINE WITH IMPROVED COMMUNICATION FUNCTION FOR CENTRALIZED CONTROL UNIT

[75] Inventors: Kazunobu Maekawa, Toyokawa; Sumiaki Hirata, Aichi, both of Japan

[73] Assignee: Minolta Camera Kabushiki Kaisha, Osaka, Japan

[21] Appl. No.: 126,736

[22] Filed: Sep. 27, 1993

Related U.S. Application Data

[63] Continuation of Ser. No. 682,259, Apr. 8, 1991, abandoned.

[30] Foreign Application Priority Data

| | | | |
|---|---|---|---|
| Apr. 10, 1990 | [JP] | Japan | 2-95265 |
| Apr. 10, 1990 | [JP] | Japan | 2-95266 |
| Jun. 14, 1990 | [JP] | Japan | 2-156231 |
| Jun. 15, 1990 | [JP] | Japan | 2-158515 |
| Jun. 29, 1990 | [JP] | Japan | 2-173578 |

[51] Int. Cl.[6] ..... G03G 21/00

[52] U.S. Cl. ..... 355/205; 355/206; 355/207

[58] Field of Search ..... 355/202, 203, 204, 205, 355/206, 207; 364/184, 185, 186; 371/29.1; 379/106

[56] References Cited

U.S. PATENT DOCUMENTS

| | | | |
|---|---|---|---|
| 3,893,175 | 7/1975 | Solomon | 355/202 X |
| 3,997,873 | 12/1976 | Thornton | 340/149 R |
| 4,162,396 | 7/1979 | Howard et al. | 371/29.1 X |
| 4,167,322 | 9/1979 | Yano et al. | 355/204 X |
| 4,241,237 | 12/1980 | Paraskevakos et al. | 179/2 AM |
| 4,322,813 | 3/1982 | Howard et al. | 364/900 |
| 4,390,953 | 6/1983 | Johnstone | 364/474 |
| 4,398,819 | 8/1983 | Schron | 355/209 |
| 4,495,596 | 1/1985 | Sciulli | 364/900 |
| 4,496,237 | 1/1985 | Schron | 355/209 |
| 4,497,037 | 1/1985 | Kato et al. | 364/900 |
| 4,549,044 | 10/1985 | Durham | 179/5 R |
| 4,583,834 | 4/1986 | Seko et al. | 355/206 |
| 4,589,080 | 5/1986 | Abbott et al. | 355/208 X |
| 4,739,366 | 4/1988 | Braswell et al. | 355/208 |
| 4,766,548 | 8/1988 | Cedrone et al. | 379/106 X |
| 4,783,748 | 11/1988 | Swarztrauber et al. | 364/483 |
| 4,797,706 | 1/1989 | Sugishima et al. | 355/200 X |
| 4,835,671 | 5/1989 | Sato et al. | 364/186 |
| 4,875,078 | 10/1989 | Resch, III et al. | 355/246 |
| 4,893,248 | 1/1990 | Pitts et al. | 379/106 X |
| 4,996,703 | 2/1991 | Gray | 379/106 X |
| 5,021,826 | 6/1991 | Maruta | 355/205 |
| 5,023,817 | 6/1991 | Au et al. | 371/29.1 X |
| 5,057,866 | 10/1991 | Hill, Jr. et al. | 355/200 |
| 5,077,582 | 12/1991 | Kravette et al. | 355/206 |
| 5,081,680 | 1/1992 | Bennet | 379/106 X |
| 5,084,875 | 1/1992 | Weinberger et al. | 371/291 |
| 5,214,772 | 5/1993 | Weinberger et al. | 395/575 |

FOREIGN PATENT DOCUMENTS

| | | |
|---|---|---|
| 142559 | 8/1984 | Japan . |
| 60-90460 | 5/1985 | Japan . |
| 61-178371 | 8/1986 | Japan . |
| 63-301667 | 12/1988 | Japan . |

OTHER PUBLICATIONS

Research Newsletter, Datquest, "Remote Diagnostic—Tool Kit of the Future", 1989, pp. 1–6.

*Primary Examiner*—A. T. Grimley
*Assistant Examiner*—Nestor R. Ramirez
*Attorney, Agent, or Firm*—Burns, Doane, Swecker & Mathis

[57] ABSTRACT

A control apparatus according to the present invention is a control apparatus collecting data about copying machines and communicating with a centralized control unit on the basis of the collected data, including a detection device for detecting trouble occurrence on the basis of the data from the copying machines, a counter for counting the number of times the trouble occurrence in response to an output of the detection device, a calculating device for calculating a trouble occurrence frequency on the basis of the number of times of trouble occurrence while the copying machine performs copying operation for a predetermined number of times, a determination device for determining that the trouble occurrence frequency calculated by the calculating device exceeds a predetermined value, and a communication device for calling the centralized control device in response to an output of the determining device.

10 Claims, 27 Drawing Sheets

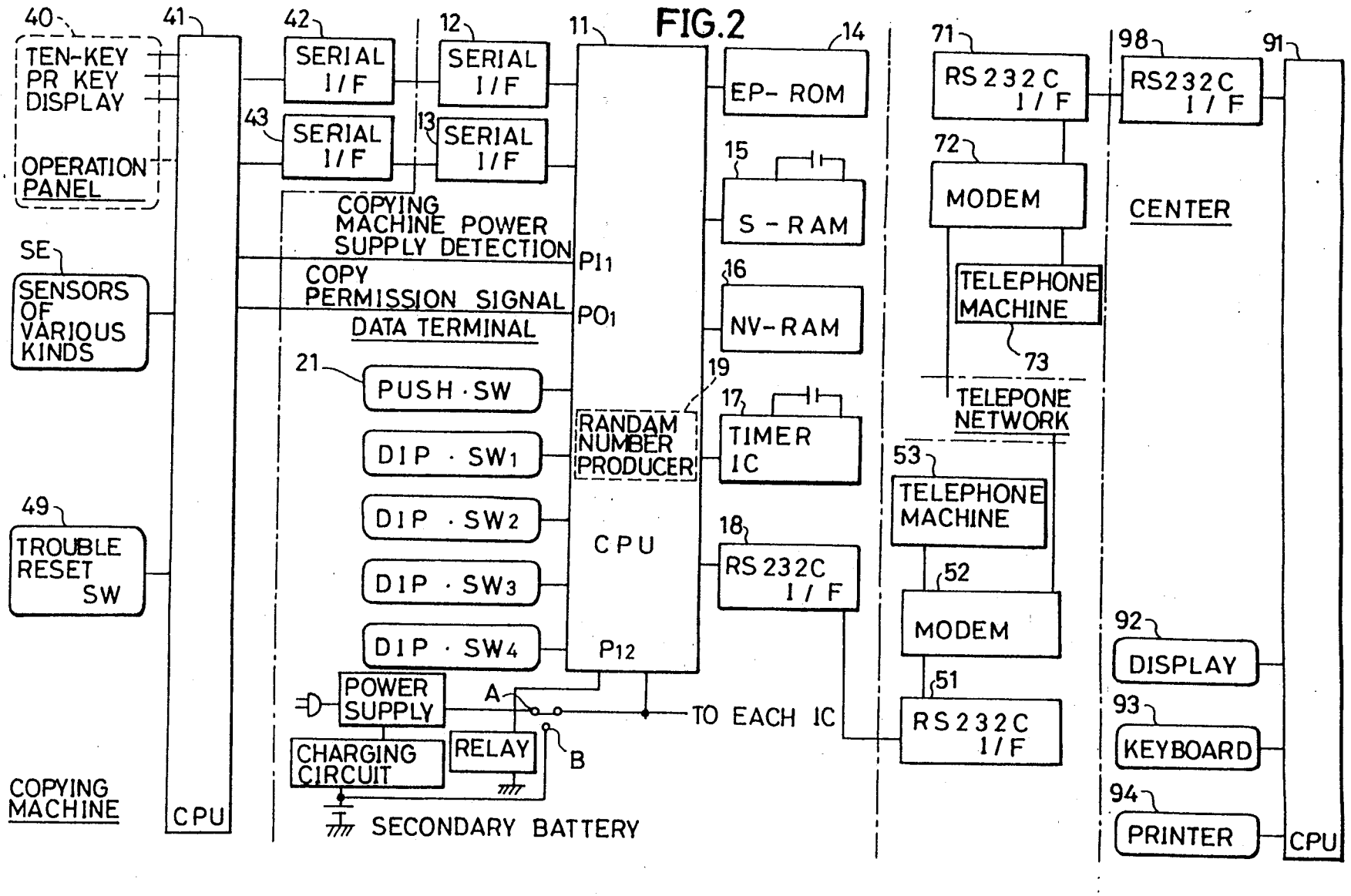
FIG.2
CENTER
CPU
91
RS232C I/F
98
DISPLAY
92
KEYBOARD
93
PRINTER
94
RS 232C I/F
71
MODEM
72
TELEPHONE MACHINE
73
TELEPONE NETWORK
TELEPHONE MACHINE
53
MODEM
52
RS 232C I/F
51
EP- ROM
14
S - RAM
15
NV-RAM
16
TIMER IC
17
RS 232C I/F
18
TO EACH IC
11
RANDAM NUMBER PRODUCER
19
CPU
P11
PO1
P12
SERIAL I/F
12
SERIAL I/F
13
COPYING MACHINE POWER SUPPLY DETECTION
COPY PERMISSION SIGNAL
DATA TERMINAL
PUSH·SW
21
DIP · SW1
DIP · SW2
DIP · SW3
DIP · SW4
A
B
RELAY
POWER SUPPLY
CHARGING CIRCUIT
SECONDARY BATTERY
SERIAL I/F
42
SERIAL I/F
43
CPU
41
TEN-KEY PR KEY DISPLAY
40
OPERATION PANEL
SENSORS OF VARIOUS KINDS
SE
TROUBLE RESET SW
49
COPYING MACHINE FIG.3
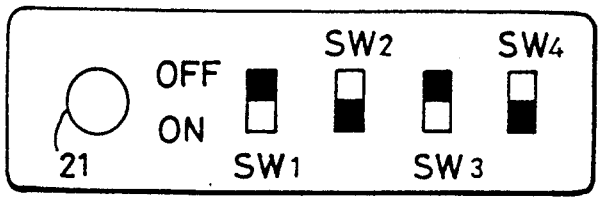
FIG.4
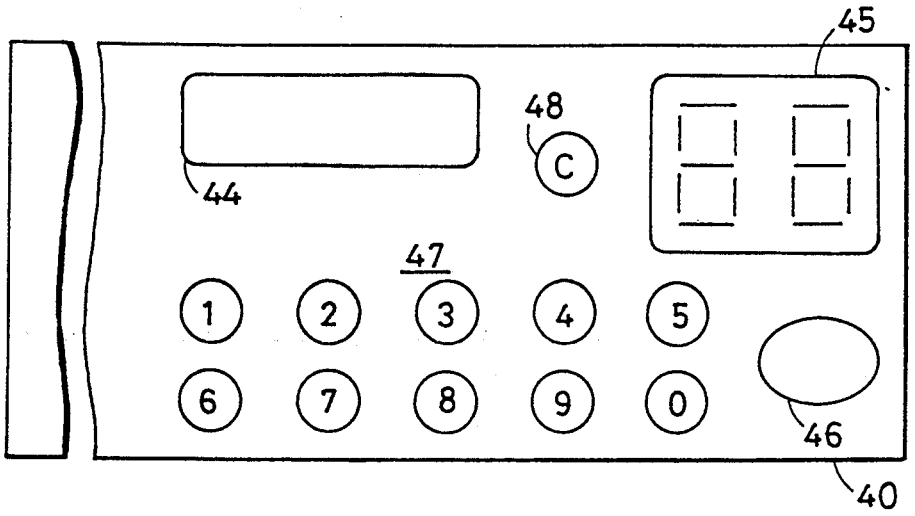
FIG.5
| b7 | b6 | b5 | b4 | b3 | b2 | b1 | b0 |
|---|---|---|---|---|---|---|---|
DISCHARGE CODE: ONE SHEET OF PAPER DISCHARGE = TRAILING EDGE OF $b_0$
JAM CODE: $b_7 = 1$, $b_6 = 0$
TROUBLE CODE: $b_7 = 1$, $b_6 = 1$

CONTROL APPARATUS FOR COPYING MACHINE WITH IMPROVED COMMUNICATION FUNCTION FOR CENTRALIZED CONTROL UNIT

This application is a continuation, of application Ser. No. 07/682,259, filed Apr. 8, 1991 now abandoned.

BACKGROUND OF THE INVENTION

1. Field of the Invention

The present invention relates to copying machine control apparatus, and particularly to copying machine control apparatus for transmission and the like of data for controlling copying machines to a centralized control unit on the center side.

2. Description of the Related Art

A system for management of a plurality of copying machines is disclosed in U.S. Pat. No. 4,583,834. In the disclosed system, various operating data of the copying machine such as a total number of copies, machine malfunctions and amounts of remaining copy sheets and toner are transmitted to a computer through a communication network. The computer processes the transmitted data and feeds back to the copying machine instructions.

A jam in a copying machine is a trouble which is likely to happen at a certain frequency even when the copying machine is normally operating. Accordingly, only by simply transmitting occurrence of a jam, it is difficult to determine as to whether or not it is a trouble requiring a measure such as dispatch of a serviceman.

When transmission to the control center is implemented through a general line, the line is occupied even when it is not urgent, which is not preferable.

In the above system, trouble detection is made in an operating condition of a copying machine.

That is, a trouble is detected with a copying machine set in a certain operating condition (the operating condition is defined by a type of the trouble) by operation such as ON of a main power supply and ON of a switch for commanding copying operation.

Accordingly, even when another operator operates the copying machine without recognizing that the copying machine is in a trouble condition, the same trouble is detected again and transmitted to the control center.

Also, even when a serviceman or a user is repairing the copying machine in order to recover the trouble, the trouble may be detected to be transmitted to the center.

Such transmission is not only useless but also not preferable because a general line is occupied in connecting the copying machine and the control center by the general communication line.

On the other hand, in a system for centralized control in which controlling data for a plurality of copying machines are transmitted to a centralized control unit at a control center through a communication network, connection with the centralized control unit can not be made in some cases.

For example, it occurs in such cases as follows; (1) transmission (center cell) from a large number of copying machine control apparatus overlap, so that the communication line (a communication terminal device) on the control center side is occupied, or (2) an abnormality takes place somewhere on the line connecting a copying machine control apparatus and a centralized control unit (a communication terminal device on the copying machine control apparatus side, a communication network, a communication terminal device on the centralized control unit side, etc.), or (3) an abnormality takes place in a copying machine control apparatus.

In the case of (1), by repeating re-dialing (to call the control center side again at a time set on the basis of a predetermined rule), connection with the center side is eventually made to enable necessary processes.

In cases where connection with the control center side can not be made due to some abnormality as the cases of (2) and (3), however, connection can not be made permanently if some measure is not taken, so that necessary processes can not be taken. The necessary process includes, for example, a process for repairing a trouble when a trouble occurs in a copying machine.

Accordingly, a user may believe that data required in copying machine control is automatically transmitted to the control center and may act on the basis of the misunderstanding. Therefore, for example, when a trouble occurs, it is possible to considerably damage the copying machine by leaving the trouble as it is.

In a copying machine control apparatus for transmitting controlling data of a copying machine to a center, various kinds of data of the copying machine are collected on line.

This is done in order to enable quick measure on the control center side when some abnormality occurs in a copying machine, or in order to enable counting the number of sheets of copy data for each copy process as a base of charge asking, for example.

Accordingly, for example, when a copying machine control apparatus stops operating due to a trouble in a power supply circuit, the data can not be collected during the stop, and there is an inconvenience that an appropriate measure on the center side can not be taken accordingly.

SUMMARY OF THE INVENTION

It is an object of the present invention to make efficient connection with a centralized control unit in a control apparatus communicating with a centralized control unit.

It is another object of the present invention to control connection possibility with a centralized control unit in accordance with the emergency of communication in a control apparatus communicating with the centralized control unit.

It is still another object of the present invention to enable appropriate measure to be taken on a centralized control unit side in control apparatus communicating with the centralized control unit.

It is yet another object of the present invention to reduce the line occupation percentage of communication with a centralized control unit in a control apparatus communicating with a centralized control unit.

It is still another object of the present invention to reduce useless transmission to a centralized control unit in a control apparatus communicating with the centralized control unit.

It is yet another object of the present invention to enhance reliability of communication connection with a centralized control unit in a control apparatus communicating with the centralized control unit.

It is still another object of the present invention to enhance reliability of data transmitted to a centralized control unit in a control apparatus communicating with the centralized control unit.

It is yet another object of the present invention to enable appropriate measure to be taken when power supply to an apparatus is cut off in a control apparatus communicating with the centralized control unit.

In order to achieve the above objects, a control apparatus in accordance with one aspect of the present invention is a control apparatus collecting data related to a copying machine and communicating with a centralized control unit on the basis of the collected data, including detecting means for detecting trouble occurrence on the basis of the data from the copying machine, counting means for counting the number of times of occurrence of trouble in response to an output of the detecting means, calculating means for calculating a frequency of trouble occurrence on the basis of the number of times of trouble occurrence while the copying machine performs copying processes for a predetermined number of times, determining means for determining that the trouble occurrence frequency calculated exceeds a predetermined value, and communication means for calling a centralized control unit in response to an output of the determining means.

In a control apparatus configured as described above, the centralized control unit is called in accordance with the trouble occurrence frequency of a copying machine, so that efficient communication is enabled.

In order to achieve the above objects, a control apparatus in accordance with another aspect of the present invention is a control apparatus collecting data related to a copying machine and communicating with a centralized control unit on the basis of the collected data, including first determining means for determining occurrence of a trouble on the basis of the data from the copying machine, second determining means for determining recovery of the trouble on the basis of the data from the copying machine, communication means for calling the centralized control unit in response to an output of the first determining means, and controlling means for controlling the communication means to forbid calls of the centralized control unit by the communication means when the first determination means determines occurrence of the same trouble again after determination of trouble again occurrence by the first determination means and before determination of recovery of the trouble by the second determination means.

In a control apparatus configured as described above, when the same trouble continuously takes place, calling of the centralized control unit is forbidden until the trouble recovery, so that it does not require unnecessary communication connection which reduces the line occupation percentage.

In order to achieve the above objects, a control apparatus in accordance with still another aspect of the present invention is a control apparatus collecting data related to a copying machine and communicating with the centralized control unit on the basis of the collected data, including communication means for calling the centralized control unit when a predetermined transmission condition is satisfied, determination means for determining that connection with the centralized control unit can not be made although the communication means is activated, and display means for displaying a predetermined message in response to an output of the determination means.

In a control apparatus configured as described above, a predetermined message is displayed when connection to the centralized control unit can not be made, so that the reliability of communication connection is enhanced.

In order to achieve the above objects, a control apparatus in accordance with yet another aspect of the present invention is a control apparatus collecting data related to a copying machine and communicating with a centralized control unit on the basis of the collected data, including means for receiving power supply from a main power source, auxiliary power supply means for performing power supply to the control apparatus when the power supply from the main power source is cut off, determination means for determining that power supply from the auxiliary power source means is implemented, and communication means for calling the centralized control unit in response to an output of the determination means.

In the control apparatus configured as described above, when the power supply from the main power source is cut off, a determination is made as to absence/-presence of power supply from the auxiliary power source to call the centralized control unit, so that an appropriate measure can be taken when the power is cut off.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2 is a block diagram showing a circuit configuration of the system of FIG. 1.

FIG. 3 is a diagram showing contents of operation switches of the control apparatus shown in FIG. 1.

FIG. 4 is a diagram showing contents of the operation panel of the copying machine shown in FIG. 1.

FIG. 5 is a diagram showing a configuration of data transmitted from the copying machine to the centralized control unit of FIG. 1.

DESCRIPTION OF THE PREFERRED EMBODIMENTS

The first embodiment of the present invention will be described below.

[1] Configuration of Entirety of System

First, referring to FIGS. 1 through 5, the schematic configuration of the present system will be described.

Figure 1:
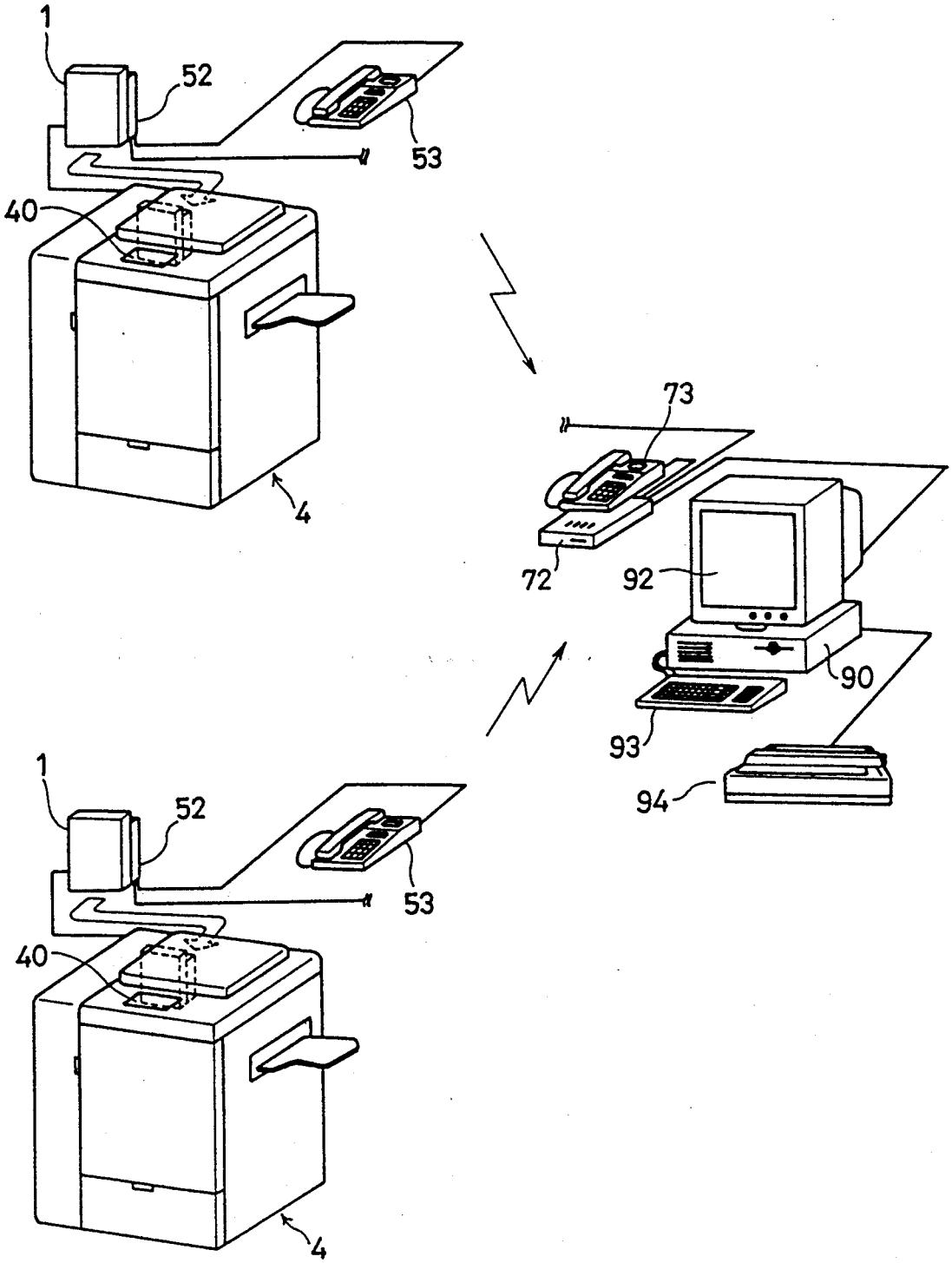
FIG. 1 is a diagram showing a configuration of a copying machine control system in accordance with one embodiment of the present invention.

As shown in FIGS. 1 and 2, the present system includes a number of user side devices (two sets of user side devices are shown in FIG. 1 and a set of user side devices are shown in FIG. 2), a center side unit which is a management base, and a communication network connecting those.

On the user side, a copying machine 4, a DT (Data Terminal) 1, a modem 52 having a function as a communication terminal device, and a telephone machine 53 which is a communication device are provided. The data terminal 1 is a device for taking in various information from copying machine 4, applying predetermined processes to the same, and transmitting the same to a computer on the center side. The data terminal 1 is usually supplied with power from a main power supply, but is supplied with power from a secondary battery when the main power source circuit is cut off, as will be described later.

On the other hand, on the center side, a modem 72 also having a function as a communication terminal device, a computer (a main body 90, a display 92, a keyboard 93, a printer 94), and a telephone machine 73 as a communication device are provided, and data for controlling copying machines are produced on the basis of the data received through the communication network (for example, a telephone line) for performing required processes.

Next, each device will be described.

Copying Machine 4

Copying machine 4 is an apparatus for forming a copied image on paper by original image scanning.

In copying machine 4, various kinds of element data having effects upon the image forming process (a time required for paper transport, a surface potential of a photoreceptor drum, a toner concentration in a developer, an amount of exposure of the photoreceptor drum, a developing bias voltage, an amount of toner sticking on photoreceptor drum, a grid voltage of a corona charger, etc.) are detected by a group of various sensors SE, which are taken in and processed in CPU 41, and then transmitted to CPU 11 of DT 1 through a serial I/F43 and a serial I/F13. The above-described various kinds of element data are expressed in an abstract manner as element data $X_i$ (i=1— the number of items of the element data) in the description of control described later.

In copying machine 4, each of counted values is counted in each counter as a base of an amount of charge asked from the management side (a total counter indicating the number of times of paper discharge and a counter for each paper size indicating the number of sheets used for each paper size), counters as criteria for maintenance (a JAM counter for each portion indicating the number of jams for each portion, a trouble counter for each portion indicating the number of troubles for each portion, and a PM counter for each part indicating the number of times each part is used), and transmitted to CPU 11 of DT 1 through serial I/F42 and serial I/F12. The PM counter is a counter for counting the number of times each part is used, which is a criterion of the time for parts replacement.

Also, copying machine 4 performs predetermined operation/mode settings with signals from various kinds of key switches on the operation panel (FIG. 4) (a print (PR) key 46 for commanding start of copying operation, a group of ten keys 47 for numerical input, a clear key 48 for commanding to clear input data, etc.), various kinds of switches out of the operation panel (a trouble reset switch 49 for commanding reset of troubles, etc.), and transmits a corresponding signal as needed to CPU 11 of DT 1 through serial I/F 42 and serial I/F12. Numerical data displayed in display portion 45 is also included in the transmitted data.

DT 1

DT 1 is a device for taking in data of copying machine 4 and activating modem 52 under a predetermined condition (a condition in which a transmission flag is set to "1", refer to the description of control described later for the details) to connect a line to the center side for transmitting data for controlling the copying machine (the above element data, the count data, the power supply off data, etc.) to the center side.

As shown in FIG. 2, a ROM 14 in which a control program is stored, a non-volatile memory 16 for storing selection number data (described later) and so forth, a system RAM 15 for works backed up by a battery, and a timer IC 17 similarly backed up by a battery are connected to controlling CPU 11 of the Data Terminal 1.

As shown in FIG. 2, a switch of a power supply circuit to CPU 11 is usually set on the contact A side by a relay, which is supplied with power from the plug side (main power supply side). It is detected with an input signal to input port PI2 from which side the power is supplied, the main power supply side/the secondary battery side.

On the other hand, when the power supply circuit is cut off on the main power supply side because of some reasons, the relay turns off and the switch of the power supply circuit to CPU 11 is switched to the contact B side. By this, the power is supplied from the secondary battery side to an IC such as CPU 11. The secondary battery is usually charged by the main power source as shown in the figure.

Such CPU 11 takes in data transmitted from copying machine 4 through serial I/F12 or serial I/F13 and applies the processes described later thereto. CPU 11 transmits a copy permitting signal from an output port PO1 to CPU 11 of copying machine 4 in an operating condition. Also, a copying machine power supply ON detection signal from CPU 41 of copying machine 4 is taken into input port PI1.

FIG. 5 is a diagram showing the data configuration of a paper discharge code, a JAM code and a trouble code which are data inputted through serial I/F12. The paper discharge code is expressed by a trailing edge (a change of the bit data from "1" to "0") of a bit $b_0$, and the JAM code is expressed as bit $b_7=1$, $b_6=0$. The trouble code is expressed as bit $b_7=1$, $b_6=1$.

CPU 11 performs predetermined operations or mode setting, etc. in response to input of operation switches. The above-mentioned operation switches include four dip switches DIP•SW1–DIP•SW4, and a push switch 21 as shown in FIG. 3.

DIP•SW4 is a switch for setting an initialization mode. DIP•SW1 is a switch for setting a center selection number (telephone number) input mode, DIP•SW2 for an ID number (DTID) input mode for distinguishing DTs 1, and DIP•SW3 for an ID number (center ID) input mode for distinguishing a center, respectively. Push switch 21 is a switch for commanding initialization transmission (refer to S145 in FIG. 8), etc.

CPU 11 is connected to modem 52 which is a communication terminal device through communication interface (RS232CI/F) 18 on the CPU 11 side and the communication interface (RS232CI/F) 51 on the modem 52 side. That is, by transmitting an off-hook signal•a center selection number signal from modem 52 to the communication line through such equipments, connection of the communication line with the center side modem 72 is made for communication with computer 90 on the center.

Contents of the data (controlling data of copying machine) transmitted to the center side from data terminal 1 are defined by a type of a transmission flag which is set to "1" as will be described later. For example, when a power supply OFF transmission flag is set to "1", data related to the power supply switching is transmitted.

Center Side Equipments

The center is a computer apparatus configured to be connected to a large number of data terminals through a communication network. With this apparatus, respective copying machines being connected to respective data terminals are controlled.

That is, the data transmitted from each of data terminals 1 side to modem 72 through the communication network are sequentially inputted in CPU 91 through the communication interface (RS232CI/F) 71 on the modem 72 side and the communication interface (RS232CI/F) 98 on the computer side. CPU 91 processes the data (the above-mentioned element data, count data, etc.) to produce data for controlling each of copying machines 4 being connected to the data terminal 1.

Furthermore, a bill is printed out on the basis of the controlling data, or a determination as to whether a serviceman should be dispatched or not, and selection of parts and so forth to be prepared for the dispatch are made.

[2]System Control

Next, referring to FIGS. 6–20, the control of the present system will be described.

Before describing flow charts, the terms "on edge" and "off edge" are defined.

The "on edge" is defined to mean a condition change in which conditions of a switch, a sensor, a signal and the like changes from an off state to an on state.

The "off edge" is defined to mean a condition change in which a state of a switch, a sensor, a signal or the like changes from an on state to an off state.

Processes in Copying Machine

Figure 6:
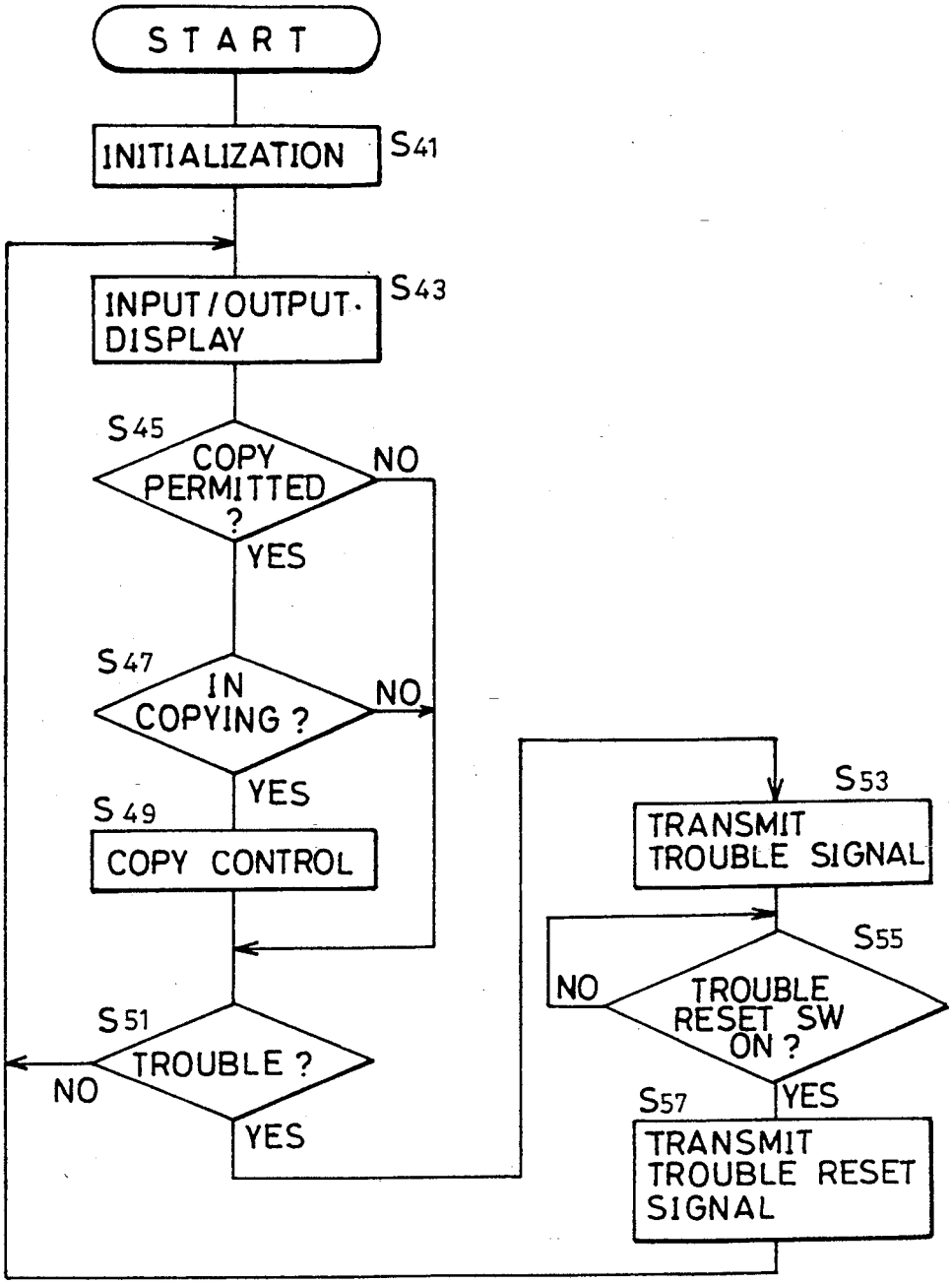
FIG. 6 is a flow chart showing control performed by a controlling CPU of the copying machine of FIG. 1.

First, the processes in control CPU 41 of a copying machine will be described referring to the flow chart of FIG. 6.

CPU 41, for example, starts processing upon turn-on of a power source, and makes initialization such as memory clear, standard mode setting or the like (S41). Subsequently, it carries out the processes in steps S43–S51.

Step S43 is a process for taking in data from switches on operation panel 40 (a group of ten-key 47 for numerical input, a print (PR) key 46 for copy start command, a clear key 48 for set number clear command, etc.), a group of switches such as a trouble reset switch 49, and data from a group of sensors not shown provided in a copying machine, and receipt data from the data terminal 1 side, and also it is a process for transmitting count data and so forth to data terminal 1.

In this step, displays in a message display portion 44 and the number of copy display portion 45 on operation panel 40 are made.

Step S49 is a process to be performed when a copy permitting signal is transmitted from the data terminal side while the data terminal is operating (YES in S45). This is a step for collectively showing processes required in copying operation, which shows paper feed control, scanning control, photoreceptor drum control, and developing device control, for example.

After the step S53, the process for trouble occurrence is shown. That is, when a trouble such as JAM occurs (YES in S51), a signal corresponding to that trouble is transmitted to controlling CPU 11 of the DT (S53). Furthermore, when trouble reset switch 49 is operated by an operator or the like (YES in S55), similarly to the above description, a trouble reset signal is transmitted to controlling CPU 11 of the DT (S57).

Processing on Data Terminal Side

Processes in controlling CPU 11 of a DT will be described referring to the flow charts shown in FIGS. 7– 17.

(a) Main Routine

Figure 7:
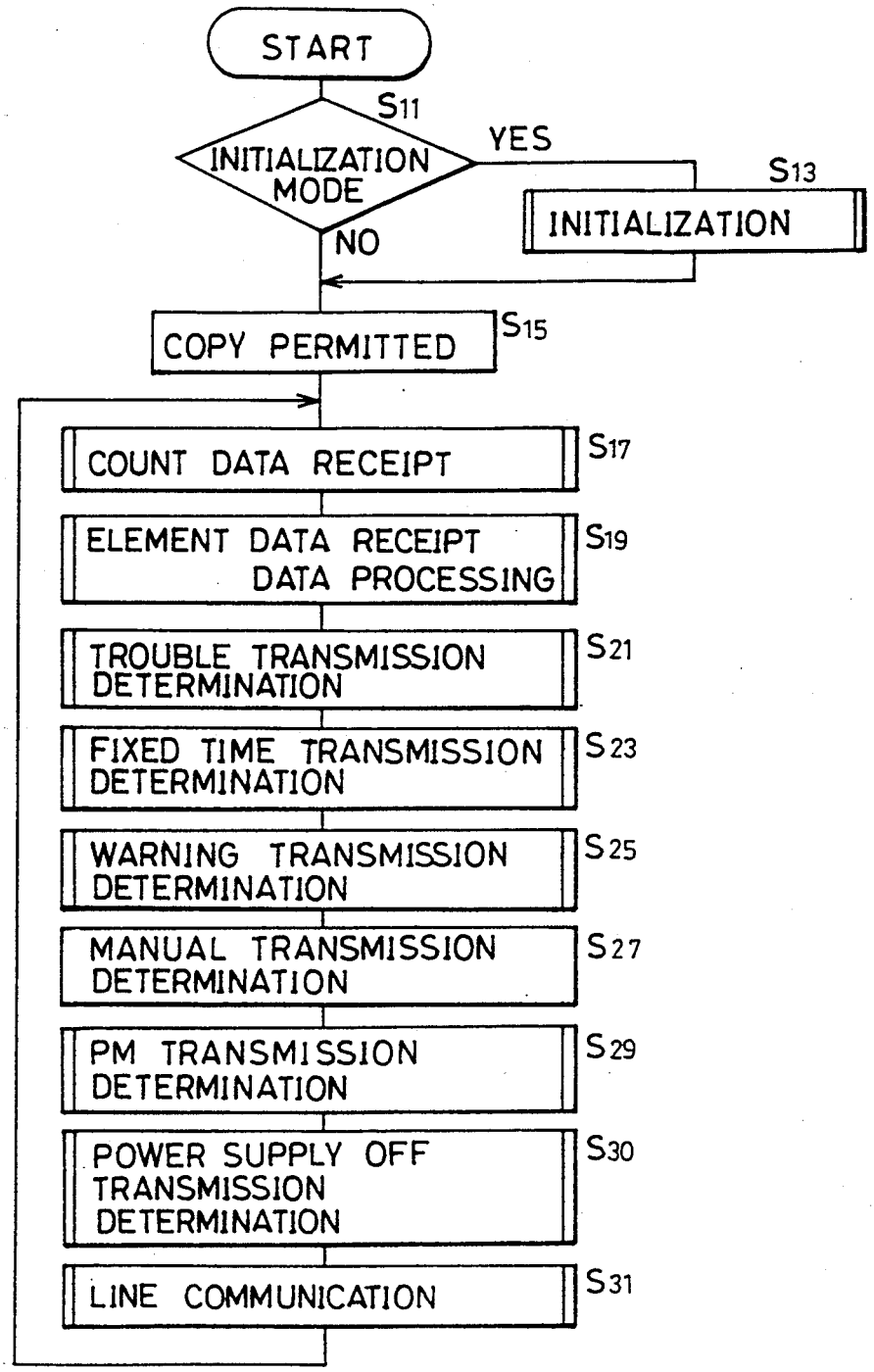
FIG. 7 is a flow chart showing a main routine performed by a controlling CPU of the control apparatus of FIG. 1.

First, the outline of the processes will be described on the basis of the main routine of FIG. 7.

The controlling CPU 11 starts processing upon turn-on of a power source, carries out an initialization process as required (S13), and then transmits a copy permitting signal to controlling CPU 41 of a copying machine (S15). Subsequently, it proceeds to the repeated loop process of steps S17–S31.

Generally, the following processes are carried out in respective sub routine steps.

* Initialization: S13

Upon turn-on of the power source, when dip switch DIP•SW4 is ON, that is, when it is an initialization mode (YES in S11), this routine is executed. Specifically, as will be described in FIGS. 8A and 8B, a selection number (telephone number) of a center, an ID number of data terminal (DTID), an ID number of the center (center ID) are set and initialization transmission is performed.

* Count Data receipt: S17

A receiving process of various kinds of count data transmitted from controlling CPU 41 of a copying machine is carried out.

The data contents include a discharge code, JAM and trouble codes, data of JAM and trouble counters, a counter for each paper size and a PM counter.

The controlling CPU 11 of a DT updates such data to the newest values and holds the same.

As will be described in FIG. 9, the jam occurrence frequency is also calculated.

* Element Data Receipt and Data Process: S19

Figure 10A:
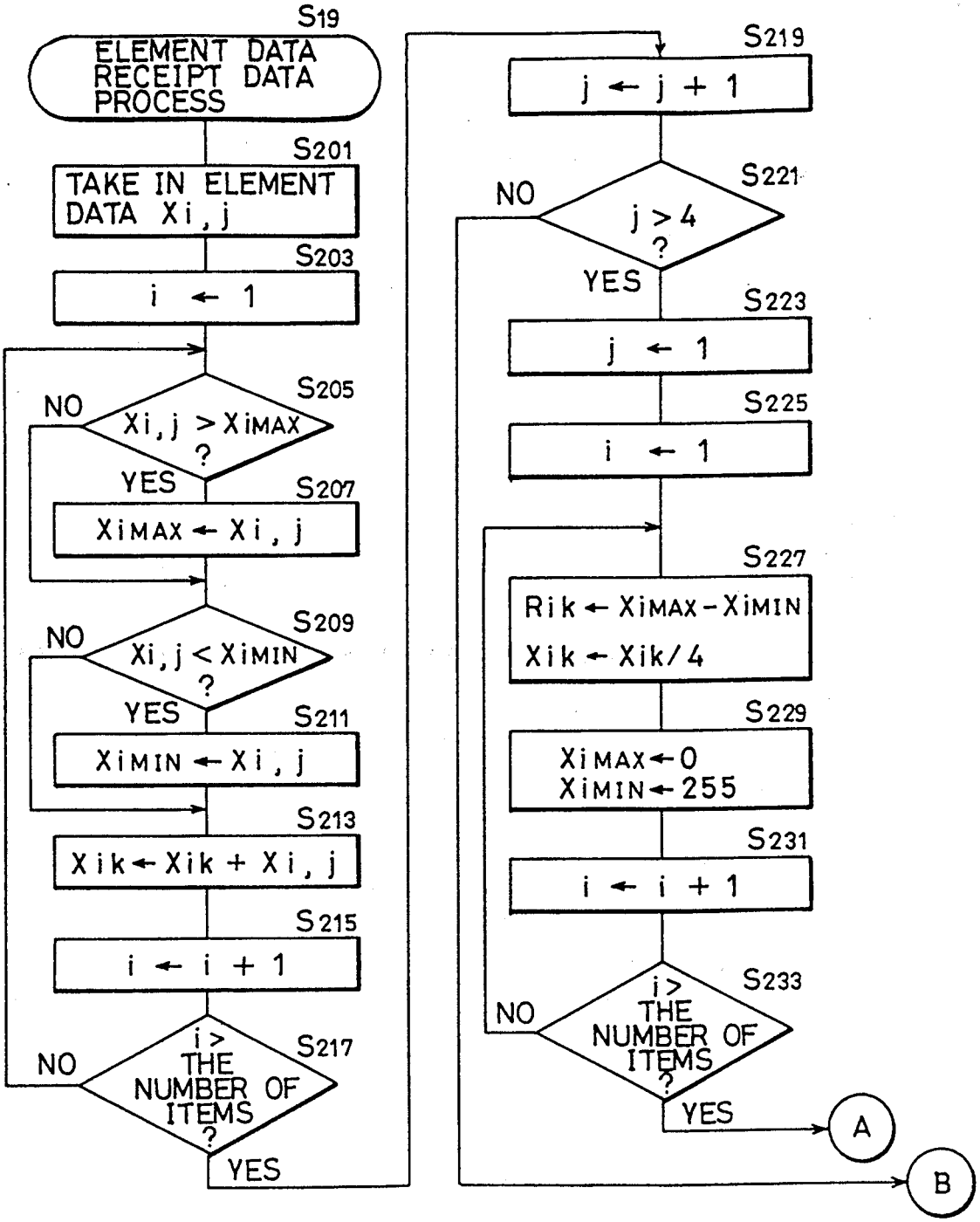
FIGS. 10A and 10B are flow charts showing specific contents of the element data receipt and data process routine of FIG. 7.
Figure 10B:
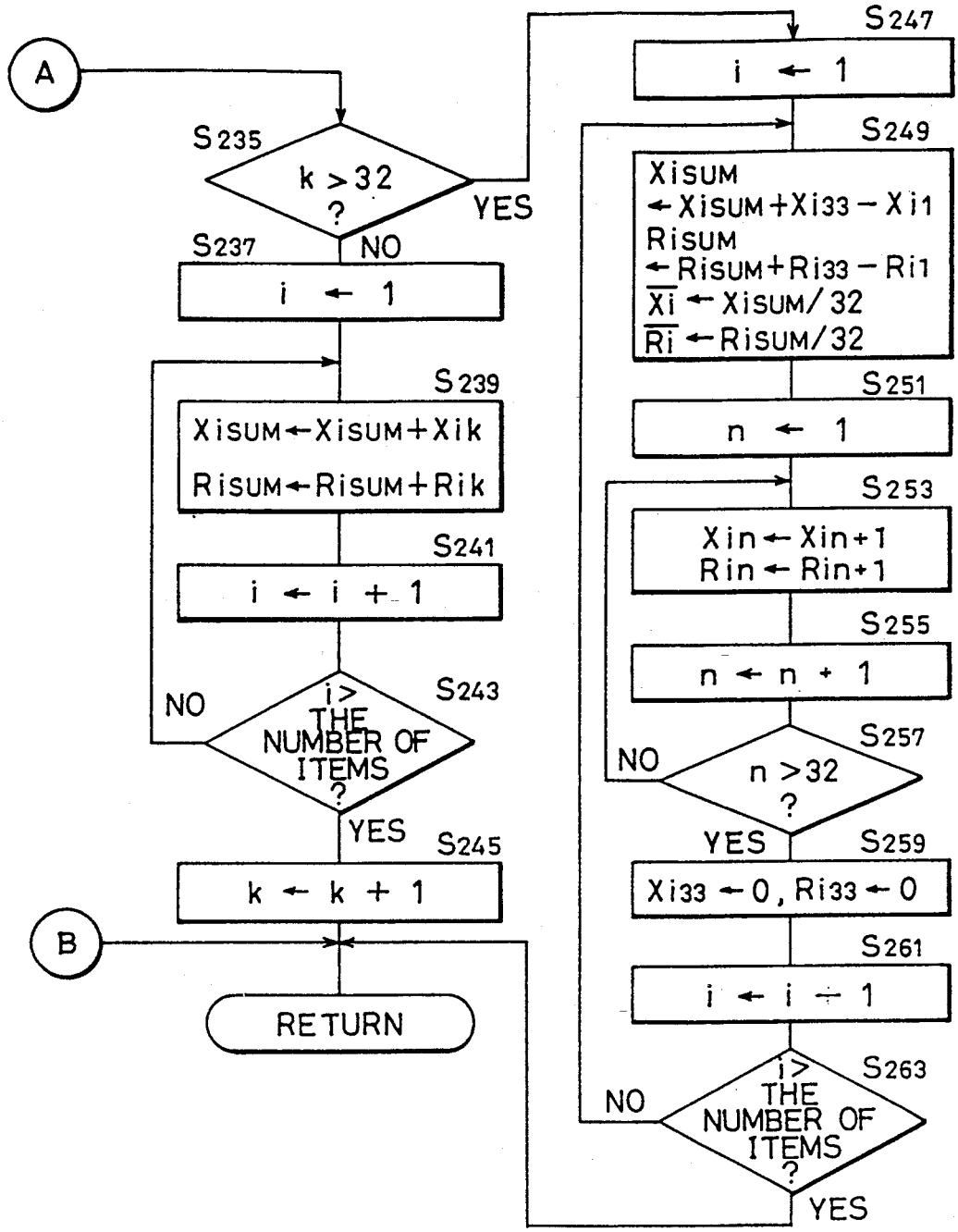

As will be described in FIGS. 10A and 10B, CPU 11 sequentially calculates data corresponding to an average value of each element data and a standard deviation to update them to the newest values.

* Trouble Transmission Determination: S21

As will be described in FIG. 11, a determination is made as to, for example, whether or not the trouble data and trouble recovery data should be transmitted to the center.

* Fixed Time Transmission Determination: S23

As will be described in FIG. 12, a fixed time transmission flag is set to 1 at a predetermined fixed time transmission time and various kinds of count data and various kinds of element data are transmitted to the center.

After completion of transmission by the fixed time transmission, fixed time transmission time data for the next time, current time data and data of the closing date of a bill are transmitted from the center side.

* Warning Transmission Determination: S25

As will be described later in FIGS. 13A and 13B, element data, a counted value of a JAM counter, and a counted value of a PM counter are compared with predetermined threshold values, respectively.

On the basis of the results thereof, a determination is made as to whether or not warning data, warning recovery data should be transmitted to the center.

* Manual Transmission Determination: S27

When it is not in the initialization mode, when push switch 21 is turned on, a manual transmission flag is set to 1.

By this, various count data, various element data are transmitted to the center.

* PM Transmission Determination: S29

As will be described in FIG. 14, a count value before clearing the PM counter in which a count value is cleared to "0" by parts replacement is transmitted to the center.

* Power Supply OFF Transmission Determination: S30

As will be described in FIG. 15, the power supply OFF transmission and the power supply OFF recovery transmission are controlled according to the state of the power supply.

* Line Communication Process: S31

As will be described in FIG. 16, when any of transmission flags is set to "1", a communication terminal device on the center side is called to implement communication.

(b) Sub Routine

Next, details of respective sub routine steps will be described referring to FIGS. 8 to 17.

Figure 8A:
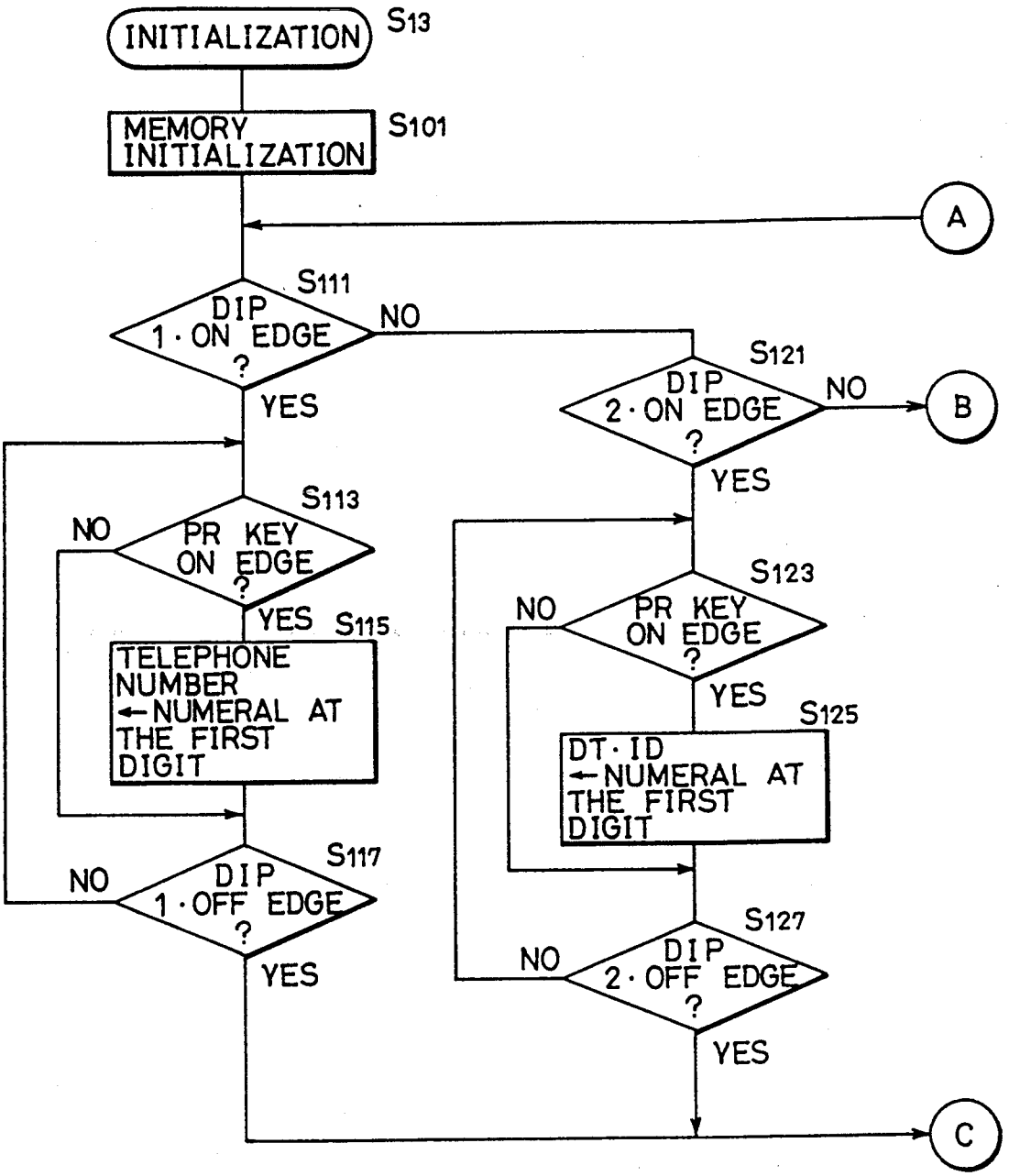
FIGS. 8A and 8B are diagrams showing specific contents of the initialization routine of FIG. 7.
Figure 8B:
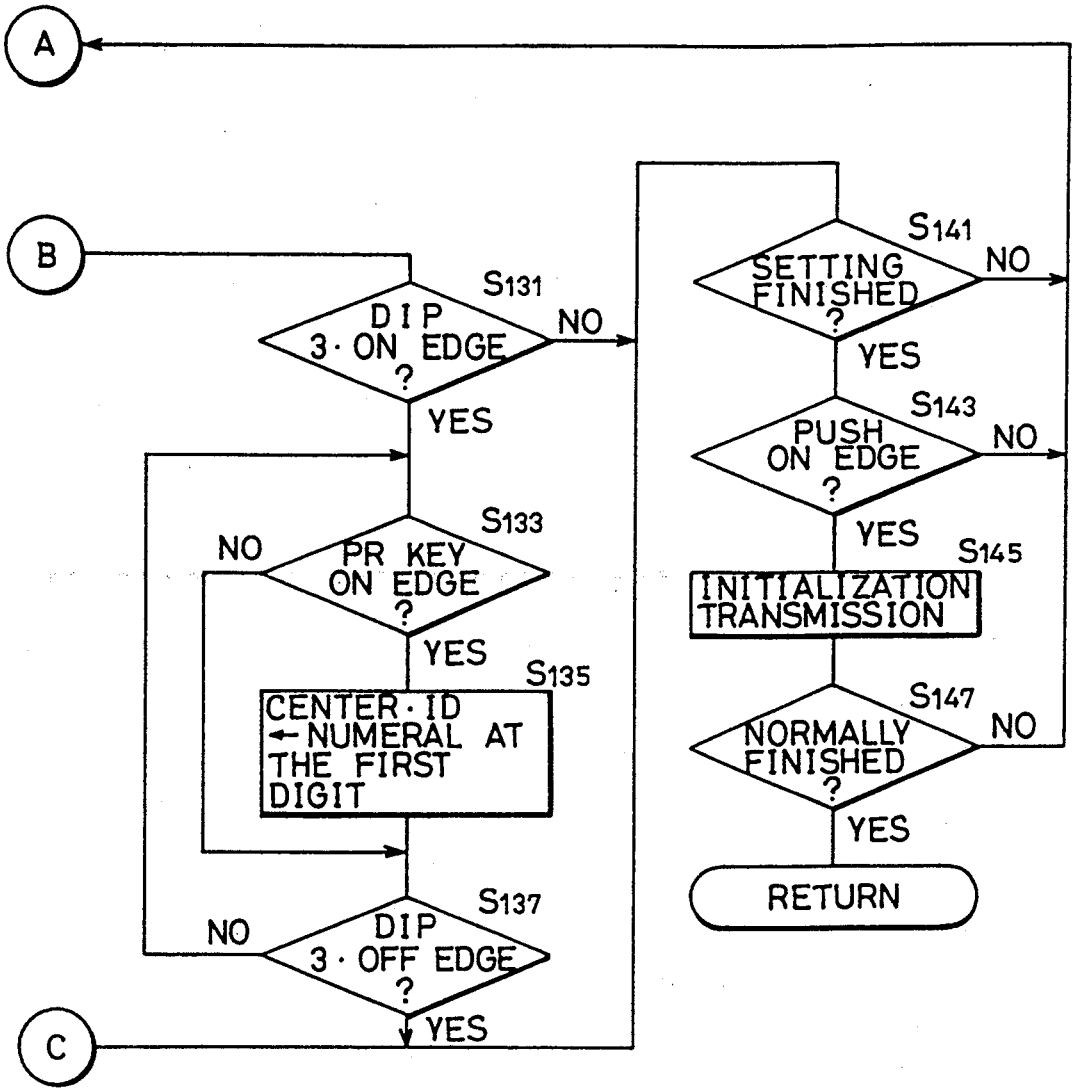

* initialization Process (FIGS. 8A and 8B)

This process is a process carried out when dip switch DIP•SW4 is on in turn-on of the power source (YES in S11), wherein initialization of a selection number of the center, an ID number of a data terminal (DTID) and an ID number of the center (center ID) are accepted, and then initialization transmission is carried out.

First, memory 15 is initialized (S101), and ON of dip switches DIP•SW1–DIP•SW3 are stood by.

When DIP•SW1 is turned on (YES in S111), an input mode of the selection number (telephone number) is implemented. That is, a figure inputted with ten key 47 of the copying machine and displayed at the first digit of display portion 45 is stored in a nonvolatile memory 16 (S115) as selection number data of the center in response to input of print key 46 (YES in S113). The selection number input mode is released with OFF of DIP•SW1 (S117).

Similarly, in response to ON of DIP•SW2 (YES in S121), an input mode of DTID is set, and a figure displayed at the first digit of display portion 45 is stored in nonvolatile memory 16 (S125) as DTID data in response to input of print key 46 (YES in S123). The DTID input mode is released with OFF of DIP•SW2 (S127).

Similarly, in response to ON of DIP•SW3 (YES in S131), an input mode of the center ID is set and a figure displayed at the first digit of display portion 45 is stored in nonvolatile memory 16 as the center ID data (S135) for every input of print key 46 (YES in S133). The center ID input mode is released with OFF of DIP•SW3 (S137).

In this way, when three kinds of data setting have been finished all (YES in S141), push switch 21 is made valid, and when the push switch 21 is depressed (YES in S143), initialization transmission is made to the center (S145).

That is, CPU 11 calls the center through the communication network to transmit the above two kinds of ID data to CPU 91 of the center. When the transmission is finished, CPU 11 receives the data transmitted from CPU 91 of the center (the closing date of the count data, the next fixed time transmission time, the current time, and a threshold value of a warning determination).

When the above transmission and receipt are finished, a determination is made as to whether the communication has been normally made or not (S147).

As a result, when the communication has not been normally performed (NO in S147), it returns to step S111 and another ON of DIP•SW1 is stood by.

On the other hand, when the communication has been made normally (YES in S147), it returns to the main routine and the processes after step S15 are carried out.

Figure 9:
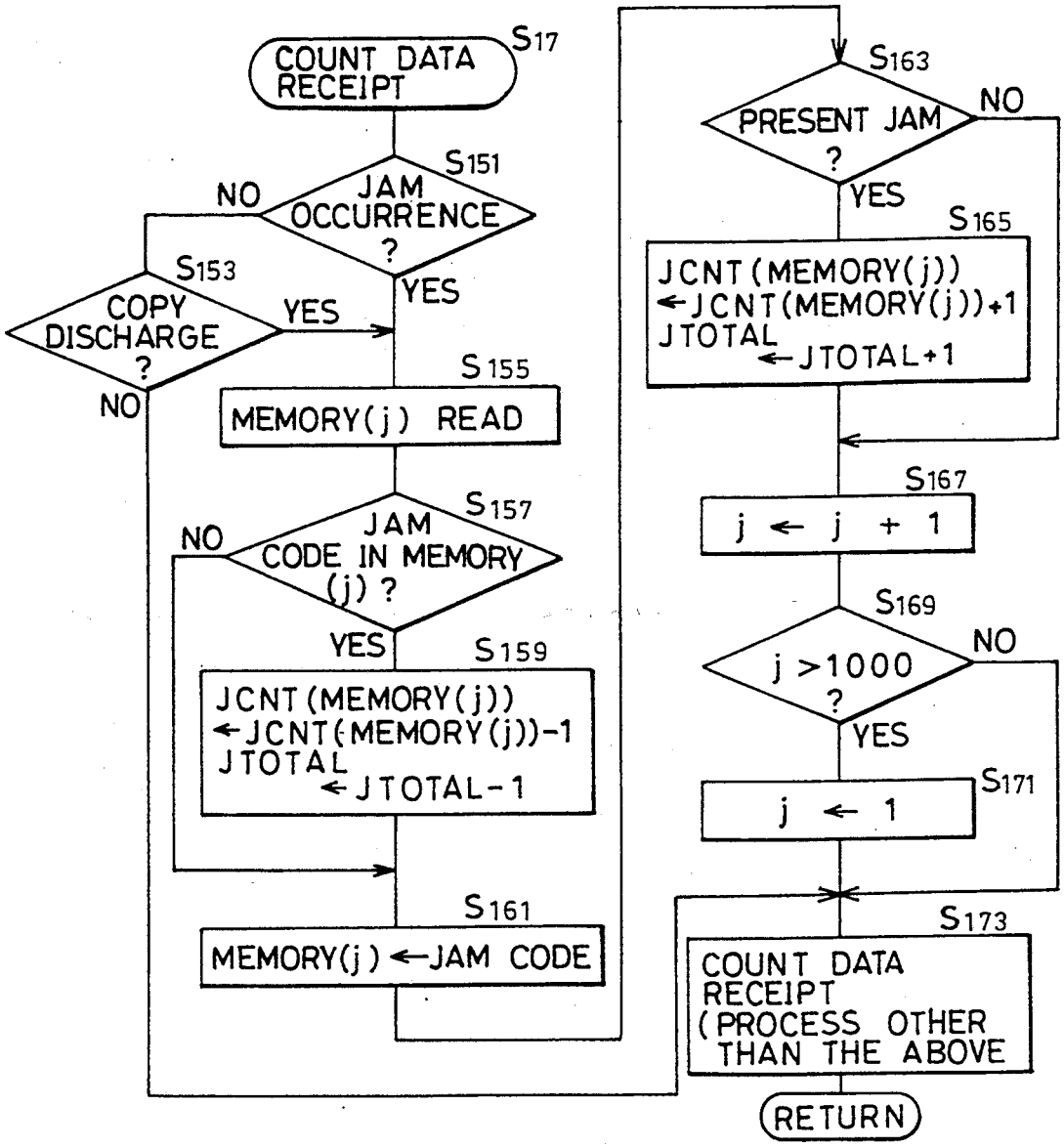
FIG. 9 is a flow chart showing specific contents of the count data receiving routine of FIG. 7.

* Count Data Receipt (FIG. 9)

In this routine, in steps S151–S171, the occurrence frequency of JAM (the number of JAMs in the newest one thousand counts) is calculated.

First, in occurrence of JAM (YES in S151), or in discharging paper (YES in S153), a memory (j) is read (S155). Here, information as to whether paper of a thousand times before caused a JAM or not is stored in the memory (j), wherein "0" is stored in the case of no JAM and JAM codes of 1-63 depending on occurrence positions are stored in the case of JAM.

When a JAM code is stored in the memory (j), that is, when it is a value other than "0" (YES in S157), a value of a counter JCNT (memory (j)) for counting the type of JAM indicated by the JAM code and a value of a counter JTOTAL for counting all the jams without any connection with the types are decremented by "1", respectively (S159). This is for removing the JAM counted in counting a thousand times before from the counted value.

When a JAM code is not stored in the above memory (j) (NO in S157), the jam was not counted in counting a thousand times before, so that the step S159 is jumped.

Next, in step S161, a JAM code indicating a type of the present JAM is stored in the above memory (j). When the present count is a count made by paper discharge, that is, when paper is discharged normally (in the case of counting with YES in S153), "0" indicating "normal condition" is stored in the memory (j).

Next, in step S163, a determination is made as to whether the present count is a count due to JAM or not (count with YES in S151) is made, and when it is count by JAM (YES in S163), a value of the above-mentioned two counters (JCND (memory (j)), JTOTAL) are incremented by "1", respectively (S165). That is, the present count is counted as JAM.

When the present count is not count due to JAM, that is, when paper is normally discharged (NO in S163), addition is not implemented in the above-described two JAM counters.

In step S167, a value of j is updated for preparation of the next count. As a result, when the value of j exceeds 1000 (YES in S169), an initial value "1" is set in j (S171).

In this way, the total number of times of JAM in counting of the newest 1000 times is stored in the counter JTOTAL, and similarly, the number of times of JAM corresponding to each type is stored in each counter JCNT (memory (j)).

The step S173 collectively shows count data receiving process other than ones described above.

* Element Data Receipt, etc. (FIGS. 10A and 10B)

In this sub routine process, data for comparison with a threshold value (refer to the warning transmission determination routine of FIGS. 13A and 13B) is calculated on the basis of the element data transmitted from a copying machine.

First, a group of element data $X_{i,j}$ transmitted from a copying machine for every discharge of copy paper are taken in from serial I/F13 (S201). Here, the subscript i expresses an item number of the element data and the subscript j expresses the order in each item.

Next, after substituting an initial value 1 for the item number i (S203), CPU 11 sequentially updates the maximum value $X_{iMAX}$, the minimum value $X_{iMIN}$ and a sum $X_{ik}$ for each item (S205-S217).

Subsequently, the subscript j is incremented (S219), and when j is 4 or less, the flow returns to the main routine.

In this way, when the processes of steps S201-S217 are carried out four times for each item (S221; YES), the subscript j is reset to 1 (S223), an initial value 1 is substituted into the item number i (S225), and the difference $R_{ik}$ between the maximum value and the minimum value and an average value $X_{ik}$ of four pieces of data are respectively calculated for each item (S227-S233). In step S229, initial values of the maximum value $X_{iMAX}$ and the minimum value $X_{iMIN}$ are given for preparation of processes in the next steps S205-S211.

After the processes of the above S227-S233, the processes of steps S237-S245, or of steps S247-S263 are carried out.

Steps S237-S245 are processes for a case in which the total of the processes of above S227-S233 does not reach thirty three times, wherein a sum $R_{iSUM}$ of the difference $R_{ik}$ between the above-mentioned maximum value and minimum value and a sum $X_{iSUM}$ of the average value $X_{ik}$ of the above-mentioned four pieces of data are calculated for the data for thirty two times for each item.

Steps S247-S263 are processes for the case in which the total of processes in the above S227-S233 is thirty three times or more, wherein a sum $R_{iSUM}$ of the above difference $R_{ik}$ and a sum $X_{iSUM}$ of the above average value $X_{ik}$ are calculated for the newest data for thirty two times for each item, and also calculating average values $\overline{X}_i$ and $\overline{R}_i$, respectively.

As described above, an average value $\overline{X}_i$ of the newest 128 ($=4\times32$) pieces of data and an average value of deviations (a value corresponding to the standard deviation) $\overline{R}_i$ are obtained for each item of the element data.

Figure 11:
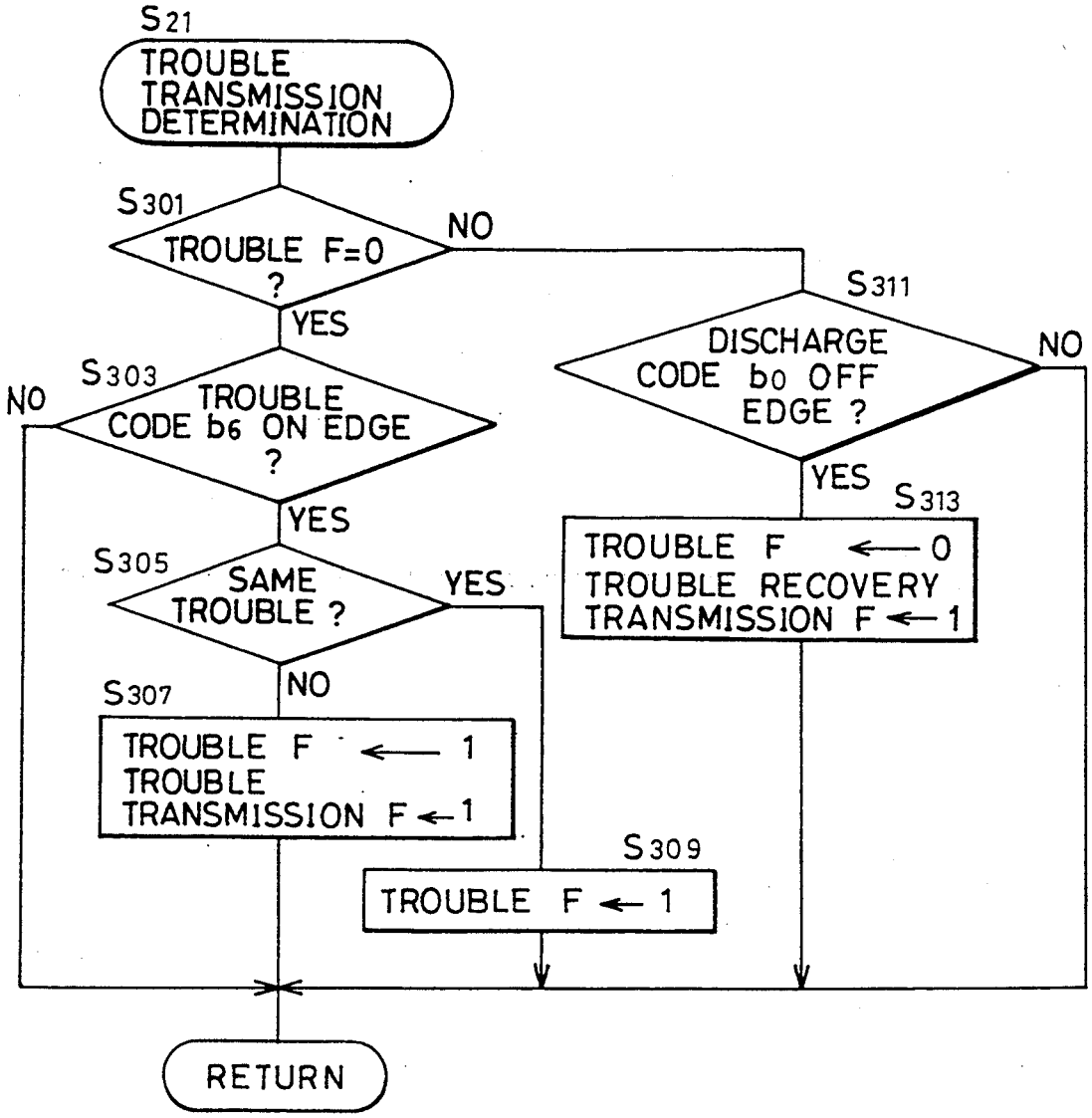
FIG. 11 is a flow chart showing specific contents of the trouble transmission determination routine of FIG. 7.

* Trouble Transmission Determination (FIG. 11)

The process is a sub routine for controlling trouble transmission and trouble recovery transmission.

That is, when "trouble flag=0" (YES in S301), if a trouble code is detected from a copying machine (YES in S303), on the condition that it is not the same trouble (NO in S4=305), a trouble flag and a trouble transmission flag are set to "1", respectively (S307). By this, the line communication process is implemented (FIG. 13), and trouble data is transmitted to the center.

When a determination of the same trouble is made in the S305 (YES in S305), a trouble flag only is set to "1", and a trouble transmission flag is not set (S309). This is because it is useless to make a plurality times of calling (center calling) with respect to the same trouble. In this process, it is considered that the same trouble may sometimes continuously occurs in dealing with the trouble.

In a condition of "trouble flag=1" (NO in S301), when a paper discharge code from a copying machine is detected (YES in S311), the trouble flag is reset to "0", and a trouble recovery transmission flag is set to "1" (S313). This is because the paper discharge in a copying machine is an operation to be performed after a trouble is recovered.

Upon setting the trouble recovery transmission flag, a line communication process (FIG. 16) is carried out and trouble recovery data is transmitted to the center.

Figure 12:
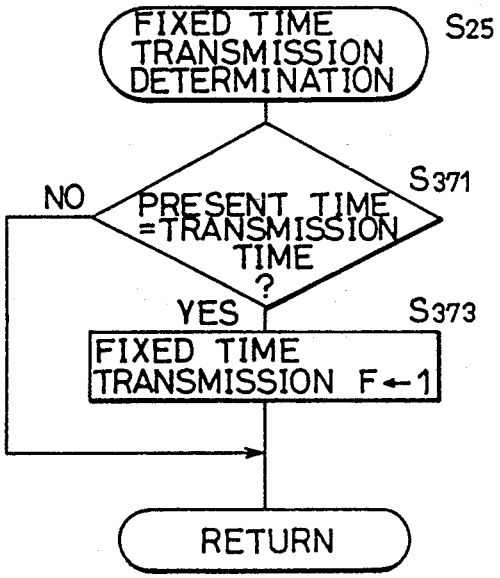
FIG. 12 is a flow chart showing specific contents of the fixed time transmission determination routine of FIG. 7.

* Fixed Time Transmission Determination (FIG. 12)

In this routine, the fixed time transmission is controlled.

That is, when the current time read from timer IC 17 coincides with the fixed time transmission time data transmitted from the center in the communication by the previous fixed time transmission (or in the communication by the initializing transmission of FIGS. 8A and 8B) (YES in S371), the fixed time transmission flag is set to "1" (S373).

Upon setting of the fixed time transmission flag, the line communication process (FIG. 16) is carried out, and the count values of the above-mentioned various counters, and various element data are transmitted to the center. CPU 11 receives from the center the next fixed time transmission time, a closing date, the current time, and a warning determining threshold value (FIGS. 13A and 13B).

Figure 13A:
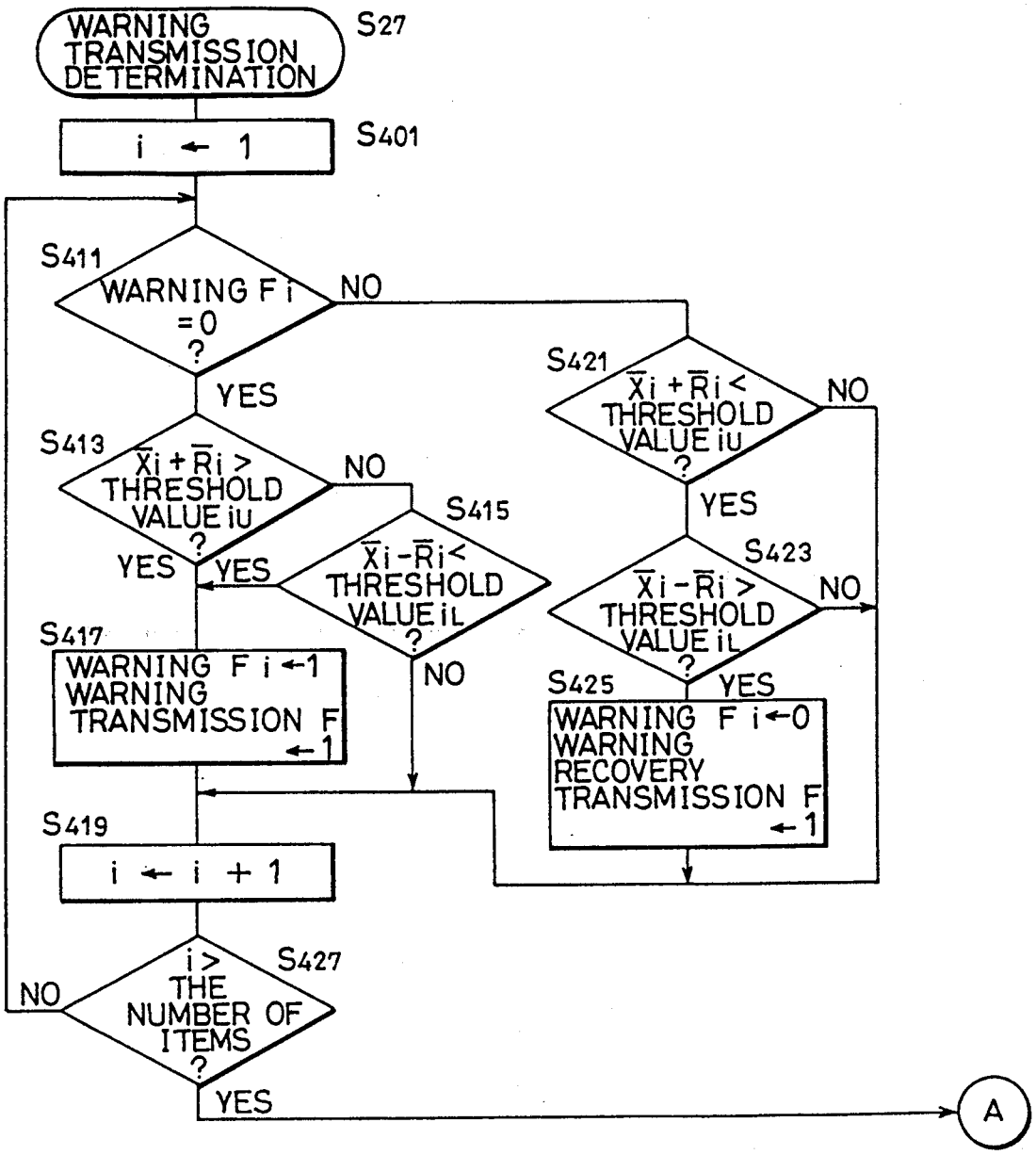
FIGS. 13A and 13B are flow charts showing specific contents of the warning transmission determination routine of FIG. 7.
Figure 13B:
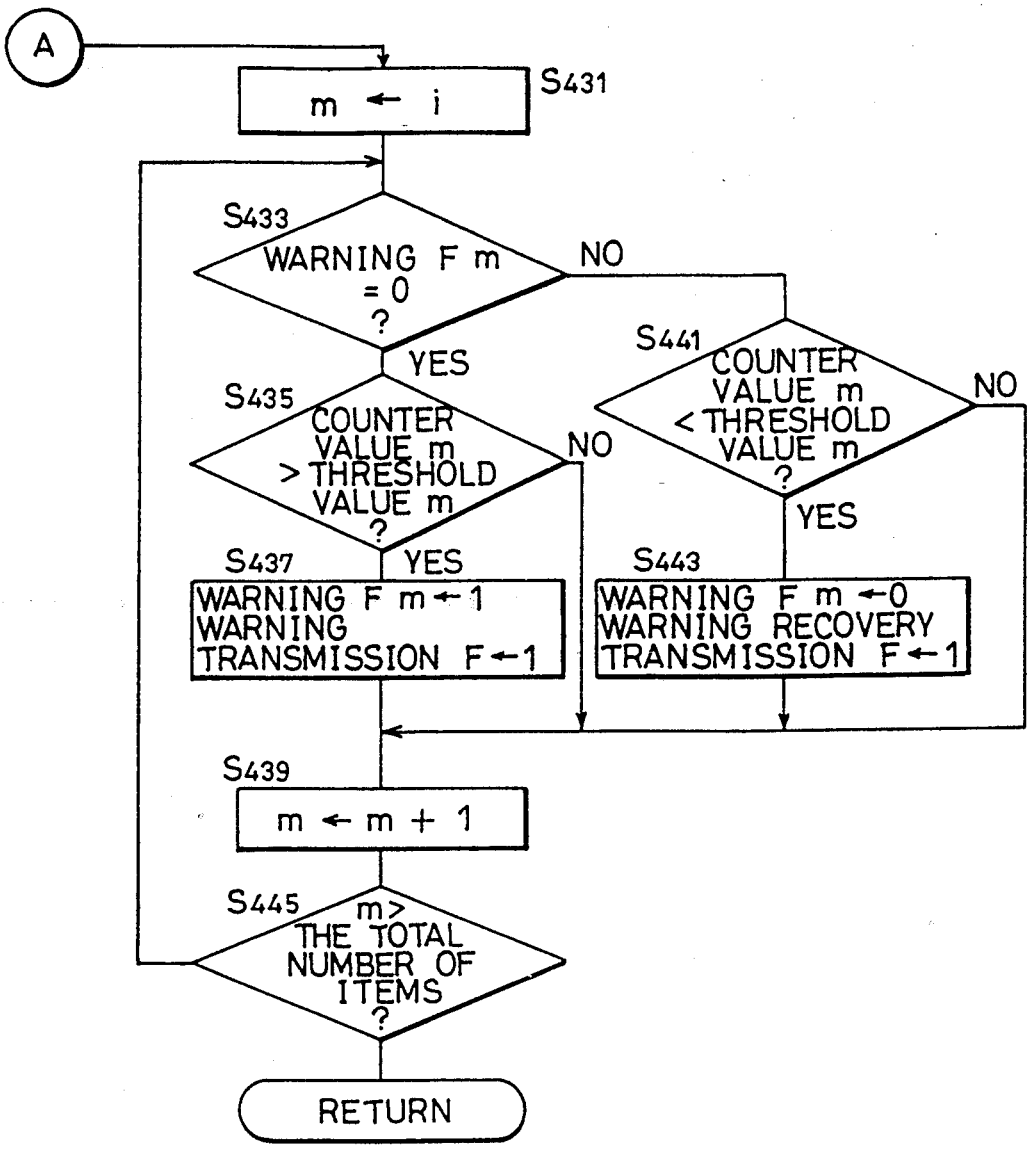

* Warning Transmission Determination (FIGS. 13A and 13B)

The present routine is a subroutine for controlling the warning transmission and the warning recovery transmission.

Steps S401–S427 are processes for implementing the warning transmission when a value of element data gets out of a permittable range peculiar to the element data, and a warning recovery transmission when it recovers in the permittable range, respectively.

First, an initial value "1" is set in the item number i indicating a type of the element data (S401).

Next, in step S411, a warning flag about objective element data (in the first time, the first element data) is examined.

As a result, when the warning flag about the particular element data is "0" (YES in S411), a determination is made as to whether or not the element data value is in the permittable range peculiar to the element data, in other words, whether or not it is in the range not more than an upper limit threshold value $_{iU}$ and not less than a lower limit threshold value $_{iL}$. When it is out of the permittable range (YES in S413 or YES in S415), a warning flag $F_i$ about the particular element data and a warning transmission flag are set to "1", respectively (S417). By this, the line communication process (FIG. 16) is carried out and warning data is transmitted to the center.

On the other hand, when a warning flag of the objective element data is "1" (NO in S411), a determination is made as to whether the value of the element data has recovered into the above-mentioned permittable range or not. If it has recovered (YES in S421 and YES in S423), a warning flag $F_i$ about the particular element data is reset to "0", and the warning recovery transmission flag is set to "1". By this, the line communication process (FIG. 16) is carried out, and warning recovery data is transmitted to the center.

After performing such processes until i attains the number of items of the element data, in other words, after performing processes with respect to all the element data, the flow proceeds to the processes after step S431.

Steps S431–S445 are processes for making warning transmission when count values (frequency) of the JAM counter and the PM counter exceed peculiar threshold values, and warning recovery transmission when they recover below the threshold values, respectively.

First, an initial value "i (the last number of the element data+1)" is set in the item number m indicating types of a JAM counter and a PM counter (S431).

Next, in step S433, a warning flag about the objective JAM counter or PM counter is examined.

As a result, when the warning flag about the particular JAM counter or PM counter is "0" (YES in S433), a determination is made as to whether or not the value of the counter is in a permittable range peculiar to the counter, or whether it dose not exceed the threshold value $_m$. When it exceeds the same (YES in S435), the warning flag $F_m$ and the warning transmission flag about the particular counter are set to "1", respectively (S437). By this, the line communication process (FIG. 16) is carried out and warning data is transmitted to the center.

On the other hand, when a warning flag about the objective JAM counter or PM counter is "1" in the above-mentioned S433 (NO in S433), a determination is made as to whether the value of the particular counter has been recovered below the above threshold value or not. In the case of recovery (YES in S441), the warning flag $F_m$ about the particular counter is reset to "0", and the warning recovery transmission flag is set to "1". By this, the line communication process (FIG. 16) is carried out and the warning recovery data are transmitted to the center.

CPU 11 performs such processes until m attains the total number of items of element data and counters, in other words, after performing with respect to all the counters, it returns to the main routine.

As described above, the warning transmission and the warning recovery transmission are controlled.

Figure 14:
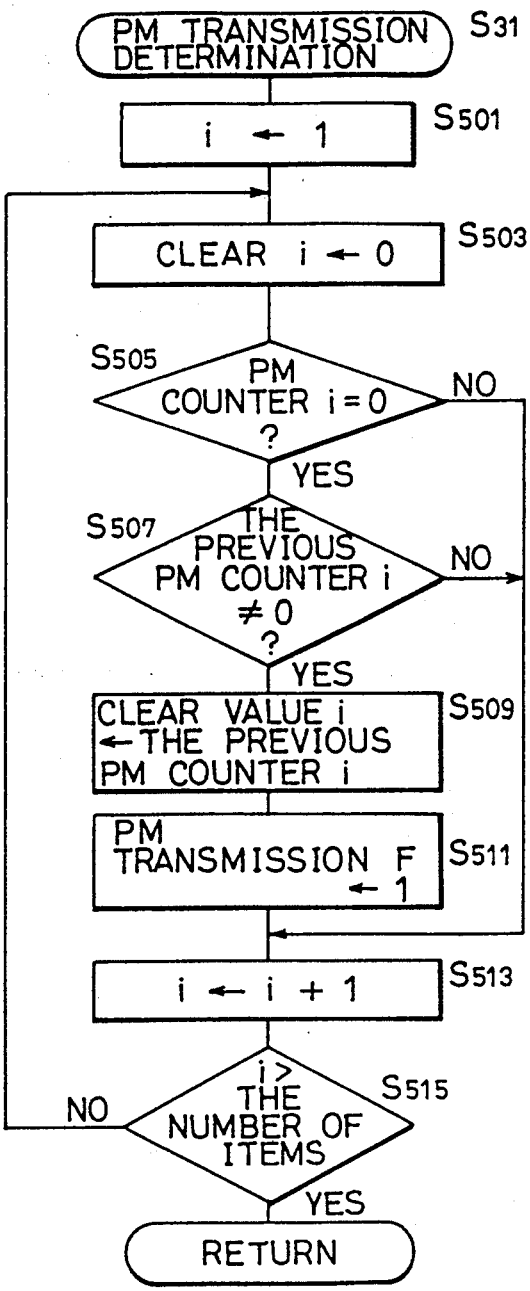
FIG. 14 is a flow chart showing specific contents of the PM transmission determination routine of FIG. 7.

* PM Transmission Determination (FIG. 14)

In this routine, the PM transmission is controlled.

First, an item number i indicating a type of a PM counter is set to an initial value "1" (S501), and after processing in the steps S503–S511, the value of i is incremented, that is, changing a type of a PM counter, the above processes are repeated.

The processes in the S503–S511 are processes for retaining a count value immediately before clearing the PM counter and setting a PM transmission flag to "1" (S511) when a PM counter is cleared (YES in S505, and YES in S507). A PM counter is cleared by a serviceman when replacing parts corresponding to the PM counter.

When "PM transmission flag=1", the line communication process (FIG. 16) is implemented, and PM data (a type of the part replaced, a count value immediately before replacement) is transmitted to the center.

Figure 15:
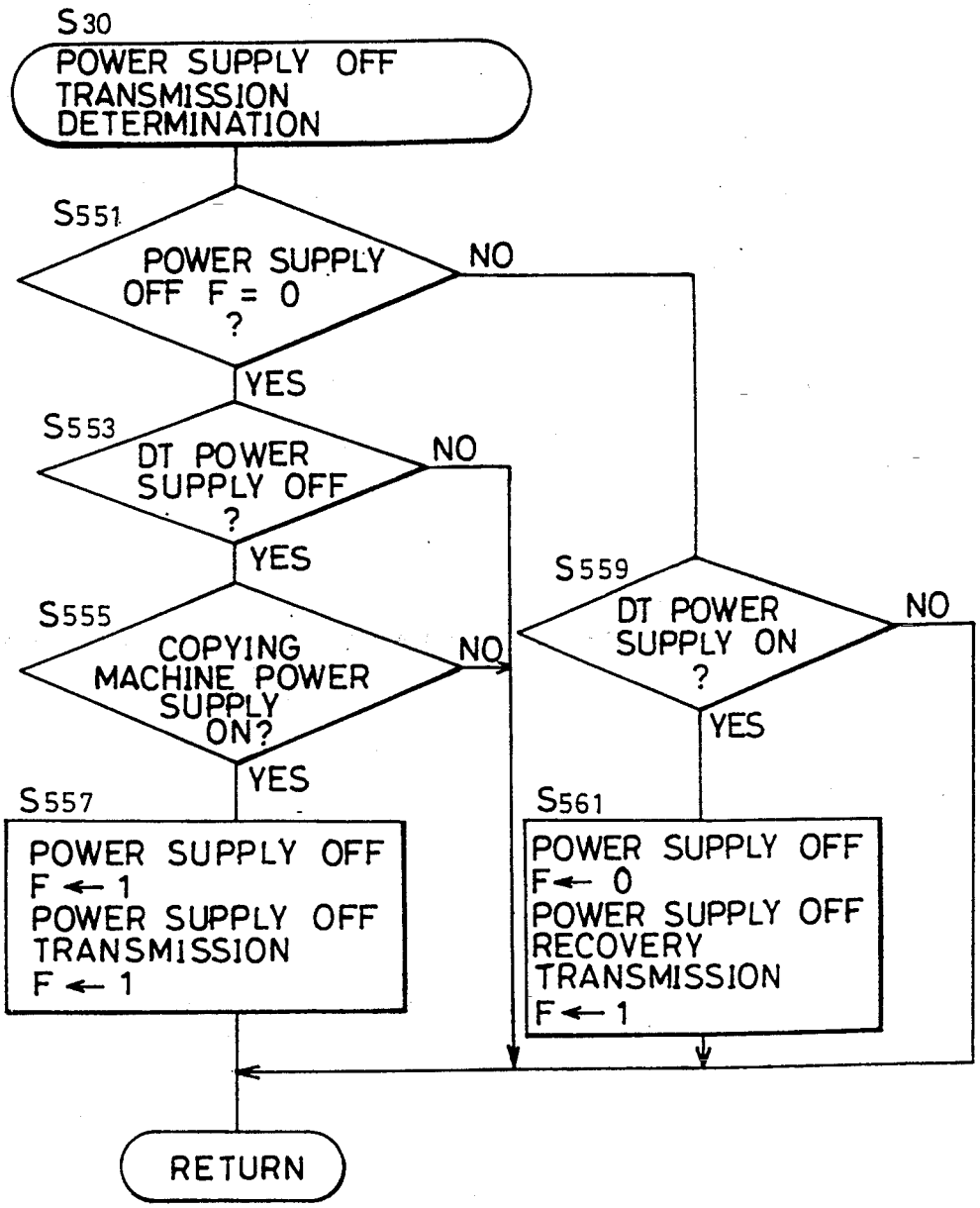
FIG. 15 is a flow chart showing specific contents of the power supply off transmission determination routine of FIG. 7.

* Power Supply OFF Transmission Determination (FIG. 15)

In this routine, the power supply OFF transmission and the power supply OFF recovery transmission are controlled.

First, in step S551, a power supply OFF flag is examined.

As a result, when the power supply OFF flag is reset to "0" (YES in S551), the power supply of CPU 11 of the data terminal is switched to the secondary battery side (YES in S553), and on the condition that the power supply of CPU 41 of a copying machine is ON (YES in S555), the power supply OFF flag and the power supply OFF transmission flag are set at "1", respectively (S557). The line communication process (FIG. 16) is implemented with setting of a power supply OFF transmission flag, and information related to the power supply switching to the secondary battery side is transmitted to the center side.

On the other hand, when the power supply OFF flag is set to "1" in the step S551 (NO in S551), if the power supply of CPU 11 of the data terminal is switched to the main power source side again (YES in S559), a power supply OFF flag is reset to "0", and the power supply OFF recovery transmission flag is set to "1" (S561). By this, the line communication process (FIG. 14) is implemented, and the information indicating that the power supply of the data terminal is switched to the main power supply side again is transmitted to the center.

Figure 16:
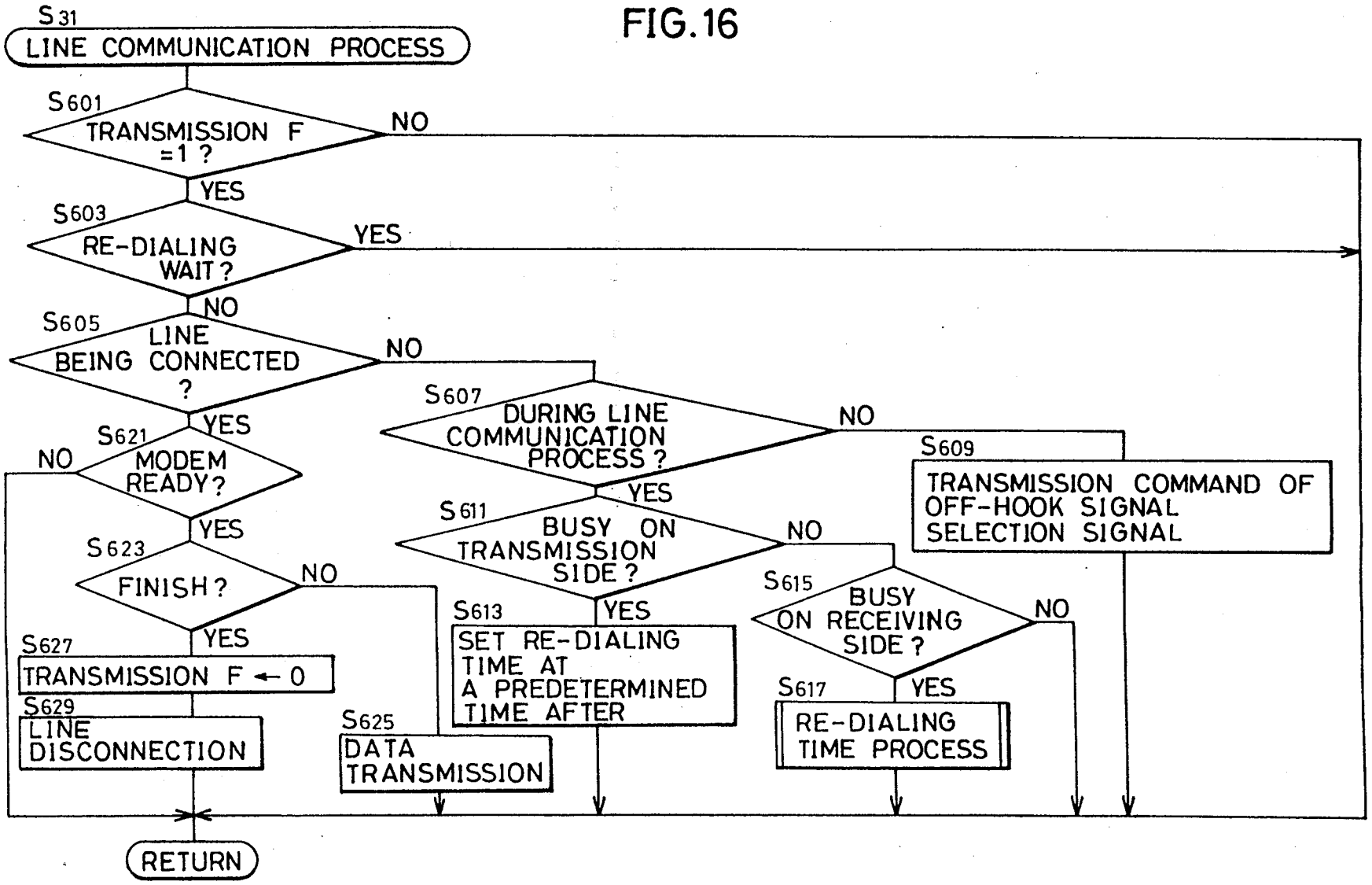
FIG. 16 is a flow chart showing specific contents of the line communication process routine of FIG. 7.
Figure 17:
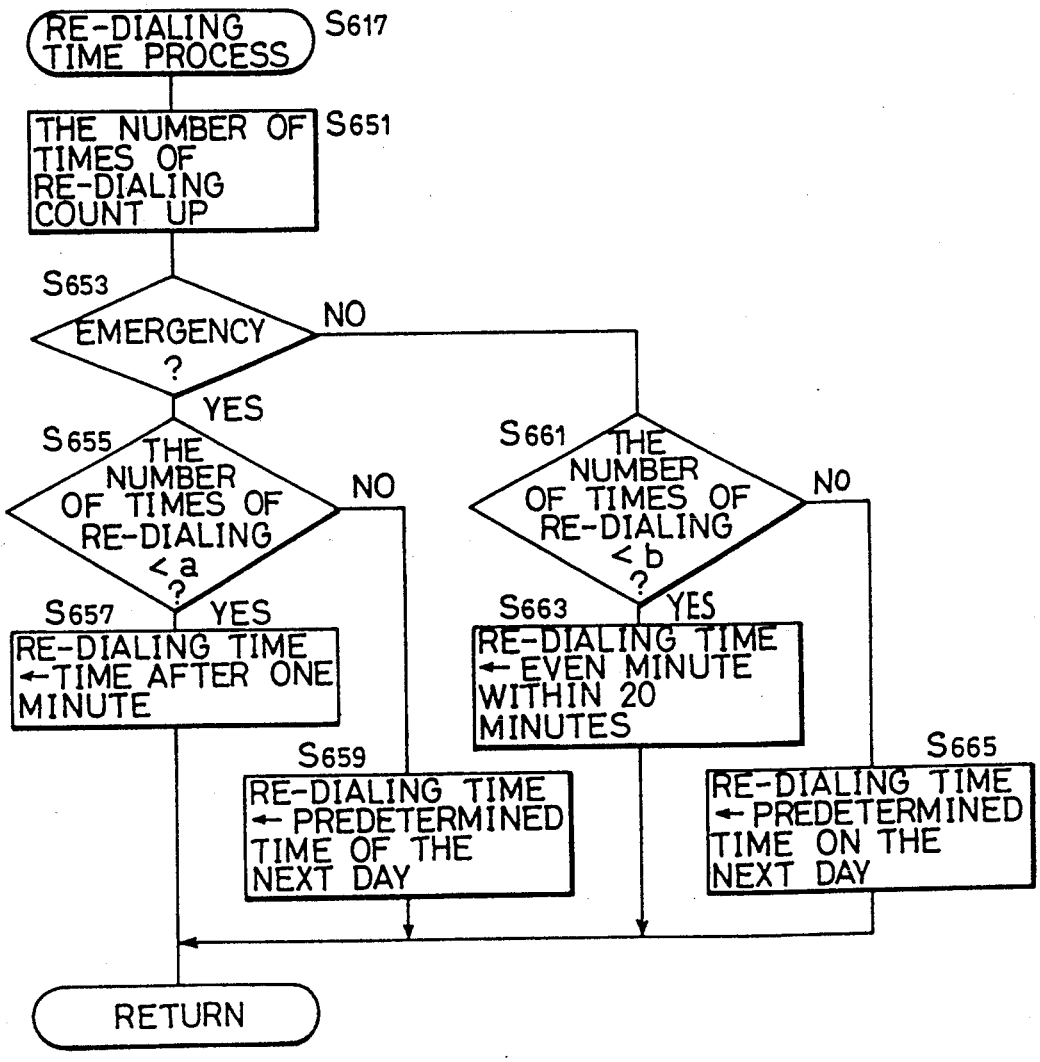
FIG. 17 is a flow chart showing specific contents of the re-dial time process routine of FIG. 16.

* Line Communication Process (FIGS. 16 and 17)

In this process, the center is called corresponding to "any of transmission flags=1", and data corresponding to the transmission flag is transmitted.

That is, when any of transmission flags is set to "1" (YES in S601), on the conditions that it is not in re-dialing standby (NO in S603), the communication line to the center side modem 72 is not connected (NO in S605), and an off-hook signal and a selection signal are not transmitted to the communication network (NO in S607), transmission of an off-hook signal and a transmission signal to the communication line is commanded to modem 52 (S609).

By the process in step S609, the determination in the next step S607 is "YES". In this case, if a telephone machine 53 of a user is "line is busy (the communication line is in use)", and modem 52 can not transmit an off-hook signal and a selection signal to the communication line accordingly (YES in S611), a time a predetermined time period after is set as a re-dialing time (S613). By the process in the S613, the determination in step S603 is "YES" until the redialing time, and the calling process for center side modem 72 is not carried out. At the re-dialing time, with NO in S603→NO in S605→NO in S607→S609, transmission of an off-hook signal and a selection signal to the communication line is commanded to modem 52 again.

By the process in the step S609, as the result of transmission of an off-hook signal and a selection signal from modem 52 to the communication line, if a determination is made that the modem 72 on the center side is "line is busy (the communication line on the center side is occupied)" (YES in S615), the re-dialing time process is implemented (S617) (described later in FIG. 17). By this, the determination in step S603 is "YES" until the time set in the re-dialing time process, and calling process of the center side modem 72 is not implemented. At the time set in the process, the center side modem 72 is called again.

On the other hand, an off-hook signal and a selection signal are transmitted from modem 52 to the communication line by the process in the step S609, and as a result, communication line is connected to center side modem 72 (YES in S605), a transmittable condition by the data transmission permission from the center side is stood by, and when it comes in the transmittable condition (YES in S621), data is transmitted to the center side (S625). The data transmitted in the step S625 is data defined by a transmission flag set to "1".

As described above, when all the data are transmitted (YES in S623), a transmission flag is reset to "0" (S627), and a line disconnection signal is transmitted to the communication line and the communication line with the center side modem 72 is disconnected (S629).

Next, the re-dialing time process (S617, FIG. 17) will be described.

The re-dialing time process is a process for setting a retransmission (re-dialing) time when connection to the center side CPU 91 could not be made (YES in S615).

First, a counter for counting the number of times of redialing (a redial counter) is counted up (S651). The counter is cleared after connection with the center.

Next, a determination is made as to whether the present dialing is a dialing in an emergency mode (in the case of trouble transmission and power supply OFF transmission) or not, and if it is the emergency mode (YES in S653), on the condition that a redial counter value is less than a (=about 10–20 times) (YES in S655), the time one minute after the present time is set as the next redialing time (S657). That is, in the case of the emergency mode, the center is called for every minute until the number of times of redialing reaches a times.

When the number of times of redialing in the emergency mode reaches a (NO in S655), a predetermined time in the next day is set as a redialing time (S659). The redialing time is set in the next day in order to avoid occupying a telephone of a user when connection to the center can not be made in spite of dialing for a times (abnormally busy network condition, operation stop of the center computer and so forth are possible by occupying the communication line on the user side).

On the other hand, when it is determined that it is not in the emergency mode in step S653 (NO in S653), on the condition that a re-dialing counter value is less than b (YES in S661), an arbitrary even minute time within twenty minutes from the present time is set as the next re-dialing time on the basis of a random number produced in a random number producing portion 19 of CPU 11 (S663). By this, even when center calling take place from a large number of data terminals, redialing times of respective data terminals are dispersed, so that the possibility of connecting to the center is enhanced.

When the number of times of redialing in the non-emergency mode is b or more (NO in S661), a predetermined time in the next day is set as a redialing time (S665). This is in order not to interfere a telephone 53 of a user and so forth by occupying the communication line on the user when making connection to the center is impossible in spite of dialing for b times (abnormally busy network, operational stop of the center side CPU 91 and so forth are possible).

The line communication process is implemented as described above, and data is transmitted to the center and data from the center is received as needed.

Processes in Center

Next, the processes in CPU 91 provided in computer 90 at the center will be described referring to FIGS. 18–20.

Figure 18:
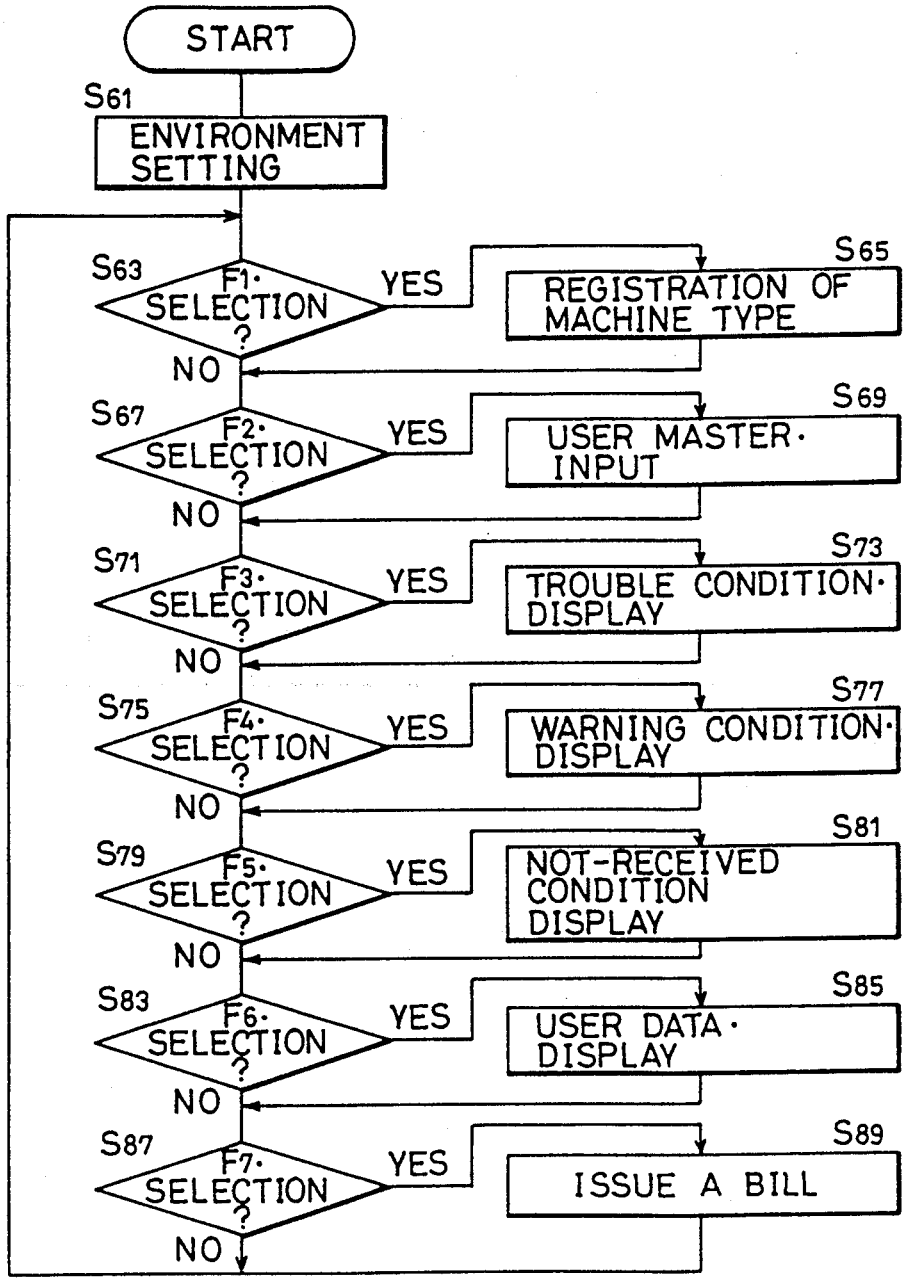
FIG. 18 is a flow chart showing a main routine of a controlling CPU of the centralized control unit of FIG. 1.

(a) F1–F7 key processes (FIG. 18)

CPU 91 starts processing upon connection of a power source, and performs environment setting of a modem, a printer and the like (S61). Subsequently, in response to input operation of each key switch on keyboard 93 F1–F7, the following modes are set or the following processes are executed.

•F1 key operation (YES in S63)

An acceptance mode of machine type registration is set (S65). That is, new registration of machine type name, the number of items of element data, a name of each element data, a standard threshold value of each element data, a standard threshold value of each counter, etc. are accepted.

•F2 key operation (YES in S67)

A registration acceptance mode of a user master is set (S69). That is, new registration of a name of user, address, telephone number, machine type name, machine number, date and time of fixed time transmission, etc. are accepted. Also, the DTID is automatically set.

•F3 key operation (YES in S71)

The trouble conditions are displayed (S73). That is, user information (a name of the user, address, telephone number, a machine type name) of a copying machine of trouble transmission, date and hour of occurrence and so forth are displayed in display 92 together with contents of the trouble. The number of trouble cases is always displayed in a corner portion of display 92 without any connection with operation of F3 key.

•F4 key operation (YES in S75)

A warning condition is displayed (S77). That is, user information and so forth of a copying machine of the warning transmission are displayed in display 92 together with the contents of the warning. The number of warning cases is always displayed in a corner portion of display 92 without any connection with operation of the F4 key.

•F5 key operation (YES in S79)

A not-received condition is displayed (S81). That is, user information of a copying machine which does not make fixed time transmission even after a predetermined fixed time transmission time is displayed in display 92. The number of no receipt cases is always displayed in a corner portion of display 92 without any connection with operation of the F4 key.

•F6 key operation (YES in S83)

A display mode for user data is implemented (S85). That is, when a user is selected, user information is displayed in display 92. Also, if a sub menu is selected, count values of various counters of the copying machine of the particular user (a total counter, a counter for each paper size, a JAM counter, a trouble counter, a PM counter) and element data are displayed for every month or for every item.

•F7 key operation (YES in S87)

A bill is printed out (S89). For example, an amount asked is calculated on the basis of a count value of the total counter and a predetermined calculation expression, and printer 94 is activated to print it out.

Figure 19:
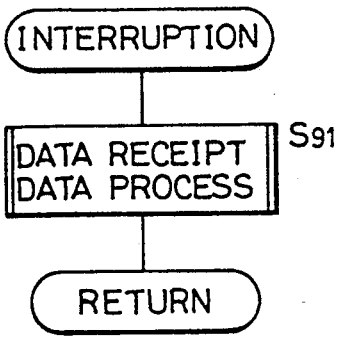
FIG. 19 is a flow chart showing an interruption process for the controlling CPU of the centralized control unit of FIG. 1.
Figure 20:
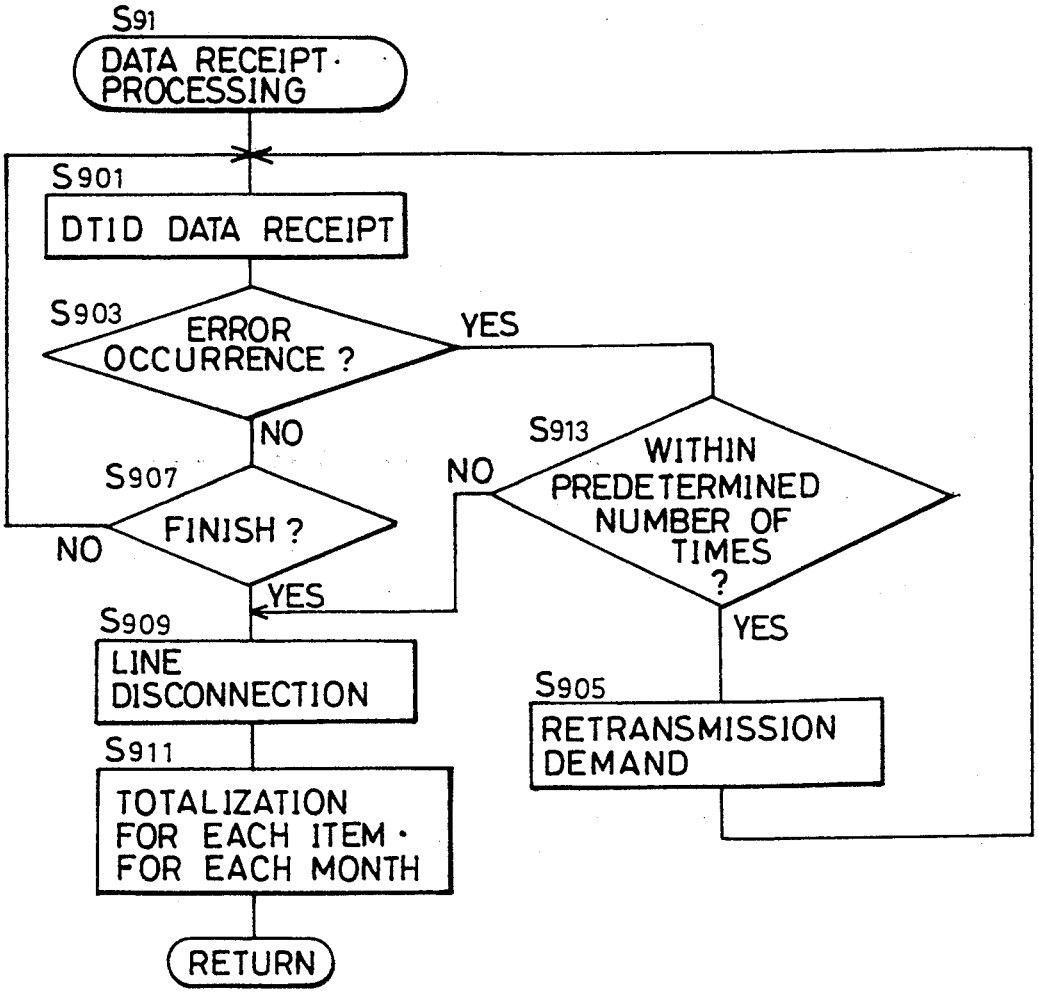
FIG. 20 is a flow chart showing specific contents of the data receipt and data process routine of FIG. 19.

(b) Interruption Process (FIGS. 19 and 20)

CPU 91 receives data transmitted from a DT by an interruption process, and also applies a predetermined process to the received data (S91).

First, when an interruption is produced on the DT side, CPU 91 receives a DTID and transmission data (S901).

When a communication error occurs (YES in S903), on the condition that the number of times of the error occurrence is a predetermined number of times or less (YES in S913), retransmission of a DTID and transmission data is requested by CPU 91 to the data terminal side (S905).

When the number of times of occurrence of the error exceeds a predetermined number of times (NO in S913), the communication line with the data terminal is disconnected (S909).

On the other hand, when communication with the data terminal has been normally finished (YES in S907), CPU 91 disconnects the communication line with the data terminal (S909) and then finds a total for each item and for each month to produce data to be displayed in a screen for an operator's selection (S911).

As described above, the processes in CPU 41 of a copying machine, CPU 11 of a data terminal, and CPU 91 of the center are performed, and the present system in which each user and the center which is a management base are connected through communication line is controlled.

Next, the second embodiment of the present invention will be described.

In the second embodiment, a message display is made when communication between a DT and the center can not be made. The above-described first embodiment and the second embodiment are different from each other in the line communication process subroutine described in FIG. 14, so that the different point will be described referring to FIGS. 21A and 21B. Other figures of the first embodiment can be shared with the second embodiment, so that description about those figures is not repeated in this embodiment.

Figure 21A:
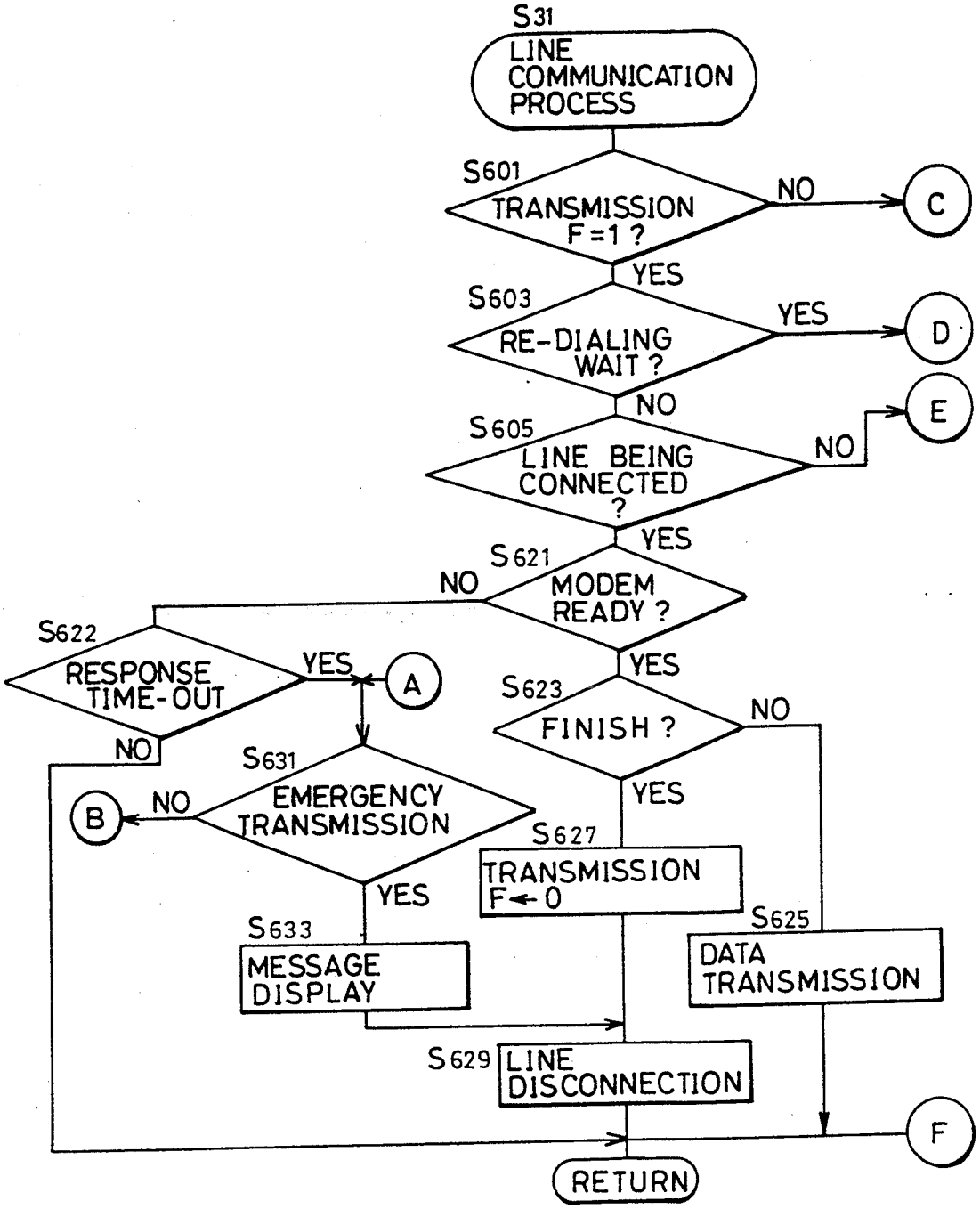
FIGS. 21A and 21B are flow charts showing specific contents of a line communication process routine in accordance with the second embodiment of the present invention.
Figure 21B:
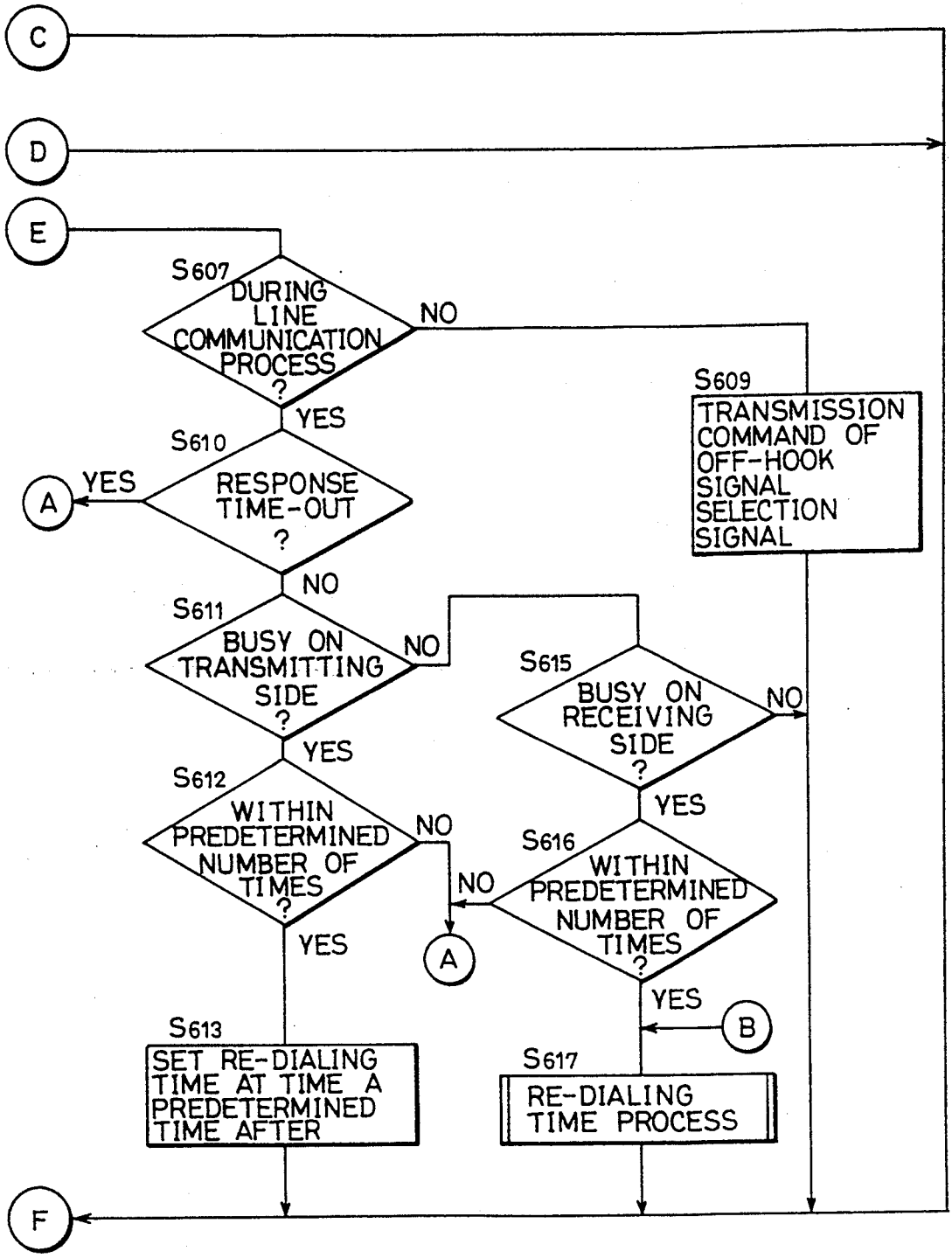

* Line Communication Process (FIGS. 21A and 21B)

In this process, the center is called in response to "any of transmission flags = 1", and data corresponding to the particular transmission flag is transmitted.

That is, when any of transmission flags is set to "1" (YES in S601), on conditions that it is not in a re-dial standby (NO in S603), the network with the center side modem 72 is not connected (NO in S605), and an off-hook signal and a selection signal are not transmitted to the communication line (NO in S607), transmission of an off-hook signal and a selection signal is commanded to modem 52 (S609).

As the result of the process in the S609, when the telephone machine 53 is "line is busy", and an off-hook signal and a selection signal can not be transmitted accordingly (YES in S611), a re-dial time (a time after the above predetermined time period) is set (S613). However, it is performed on the conditions that a predetermined time has not passed after the process in step S609 (NO in S610), and the number of times of impossible transmission because of "line is busy" of telephone machine 53 did not exceed a predetermined number of times (YES in S612). After the predetermined time period (YES in S610), or after it exceeds the predetermined number of times (NO in S612), the flow proceeds to step S631 described later. By this, until the above-mentioned redial time, the determination in the S603 is "YES", and the process of calling center side modem 72 is not carried out, accordingly. At the redial time, with NO in S603→NO in S605→NO in S607→S609, modem 52 is commanded to transmit an off-hook signal and a selection signal again.

As the result of transmission of the off-hook signal and the selection signal to the communication network from modem 52 in accordance with the process in the S609, when a determination is made that the modem 72 on the center side is "busy (the communication line on the center side is occupied)" (YES in S615), the redial time process (FIG. 17, described before) is carried out (S617). The redialing time process (S617) will be described later. It is made on the condition that the number of times of impossible connection due to "line is busy" of the center side modem 72 is below a predetermined number of times (YES in S616). When the number of times of impossible connection exceeds the predetermined number of times (NO in S616), it proceeds to step S631 which will be described later. The determination in step S603 is "YES" until a time set in the process by the above-described re-dialing time process (S617), and the calling process of center side modem 72 is not executed. At the time set in the process, the center side modem 72 is called again.

On the other hand, as the result of the transmission of the off-hook signal and the selection signal to the communication network from modem 52 in accordance with the process of the above S609, when the line is connected with the center side modem 72 (YES in S605), after standing by the transmittable condition by data transmission permission from the center side, the data is transmitted to the center (S625) when it comes in the transmittable condition (UES in S621). It is made on the condition, however, that it comes in a transmittable condition within a predetermined time period (NO in S622). When it does not come in the transmittable condition within the predetermined time period (YES in S622), it proceeds to step S631 which will be described later. The transmitted data is data defined by a transmission flag which is set to "1".

In this way, when all the data are transmitted (YES in S623), the transmission flag is reset to "0" (S627), and also the line with the center side modem 72 is disconnected (S629).

Next, when connection can not be made with the center side within a predetermined time period, or within a predetermined number of times, in other words, when it seems that some trouble occurs with respect to the communication with the center side, the processes after step S631 described blow are performed.

First, in step S631, it is determined whether the present transmission is transmission in an emergency mode (e.g., in trouble occurrence).

As the result when it is in the emergency mode (YES in S631), a message command signal described above is transmitted to CPU 41 of a copying machine (S633), and the communication line with the center side is disconnected as needed (S629). By this, a display is made, for example "call the service center" in message display portion 44 on an operation panel on a copying machine side (S44) to draw users attention. The message may be changed according to at which stage the connection with the centralized control unit is interfered. Also, the stage at which the connection is interfered may be displayed. For example, in the case of "YES in S622", a message is made "abnormality occurs between the center side communication terminal—computer".

On the other hand, when it is determined that it is not in the emergency mode in the step S631, it proceeds to step S617 to implement the re-dialing time process.

The third embodiment of the present invention will be described next.

Figure 24:
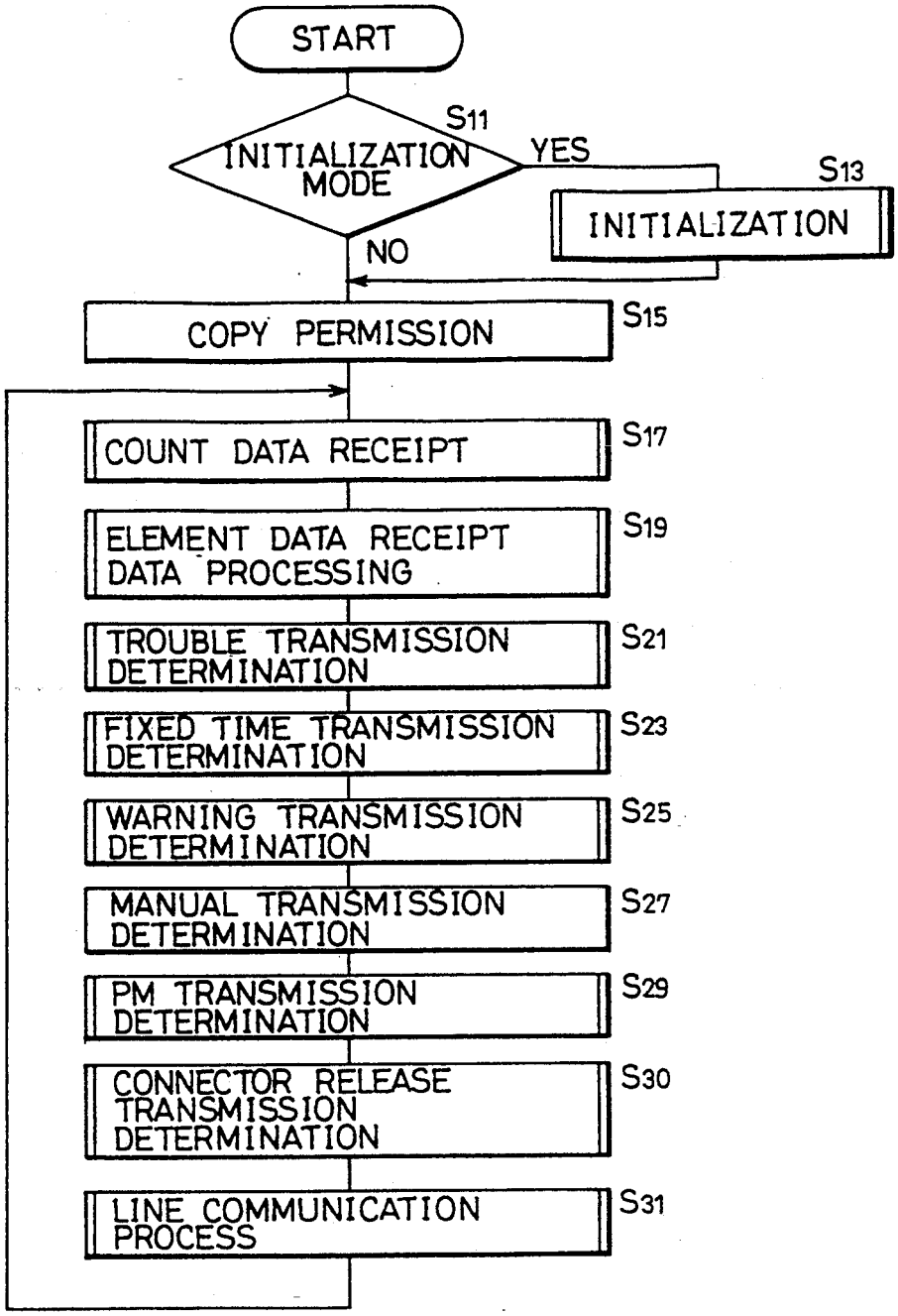
FIG. 24 is a flow chart showing control performed by a controlling CPU of the data terminal of FIG. 22.
Figure 25:
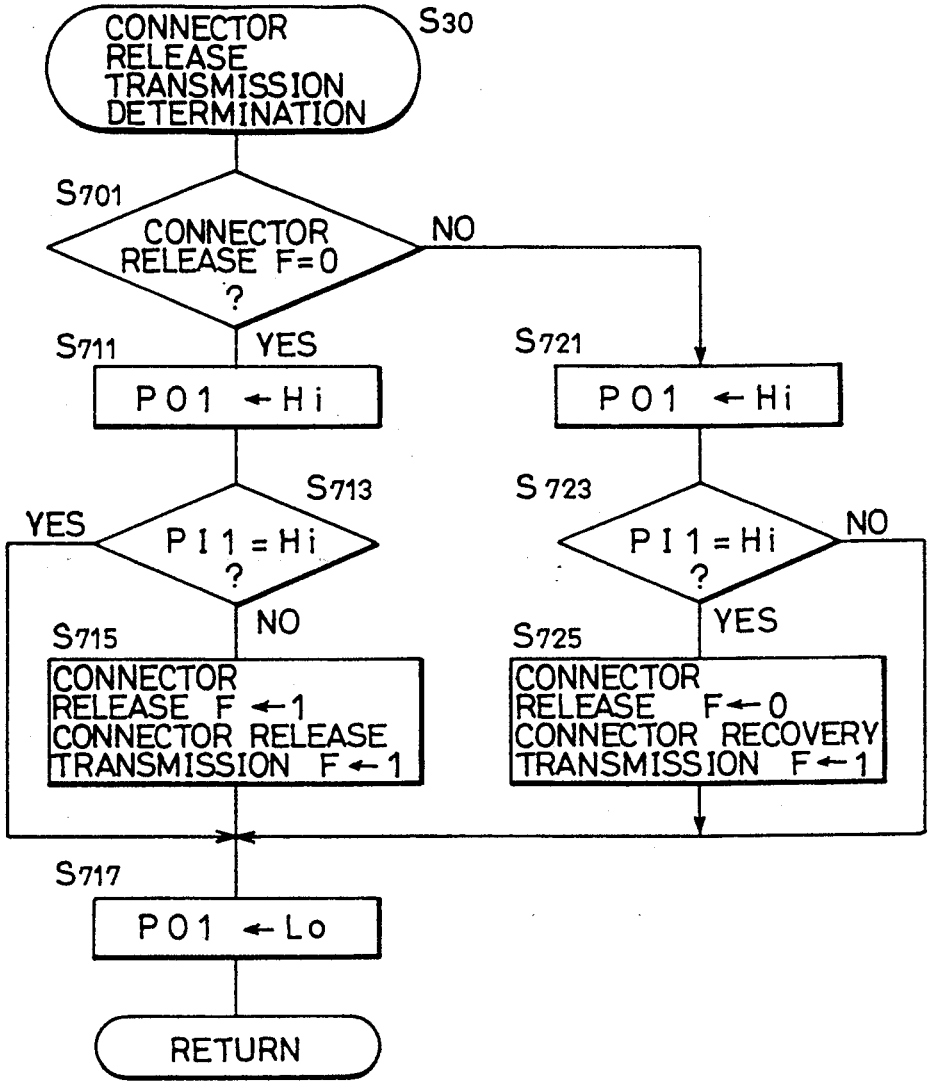
FIG. 25 is a flow chart showing specific contents of the connector release transmission determination routine of FIG. 24.

In the third embodiment, a determination is made that a connector is not connected between a copying machine and a DT, and thereby the processes are performed. The above-described first embodiment and the third embodiment are different in configuration between a copying machine and a DT, and a part of the processes by CPU 41 of a copying machine and the processes by CPU 11 of a DT. The third embodiment will be described specifically referring to FIG. 22 replacing FIG. 2 of the first embodiment, FIG. 23 replacing FIG. 6, FIG. 24 replacing FIG. 7, and the connector release transmission determination subroutine of FIG. 25 is added thereto. In the process of CPU 11 of a DT shown in FIG. 24, the connector release transmission determination subroutine is performed instead of the power supply OFF transmission determination subroutine, so that the power supply OFF transmission determination subroutine (FIG. 15) described in the first embodiment is not included in the third embodiment. As other figures of the first embodiment can be shared with the third embodiment, so that description about those figures is not repeated in this embodiment.

CPU 41 of a copying machine is provided on the same substrate as serial I/F42 and serial I/F43, and connection between serial I/F42 and serial I/F12 and connection between serial I/F43 and serial I/F13 are made by connector CN1. Connection between connector CN1 and an interface on the data terminal side (serial I/F12, serial I/F13) is detected by ON of microswitch 44*c*. Serial I/F42 is also connectable to control apparatus 44*a* through a connector CN2, and connection between the control apparatus 44*a* and connector CN2 is detected as ON of microswitch 44*b* similarly as described above. Control apparatus 44*a* is an apparatus for permitting copying operation and counting the number of sheets of copies, which is employed by a user for managing his own number of sheets of copies.

Figure 22:
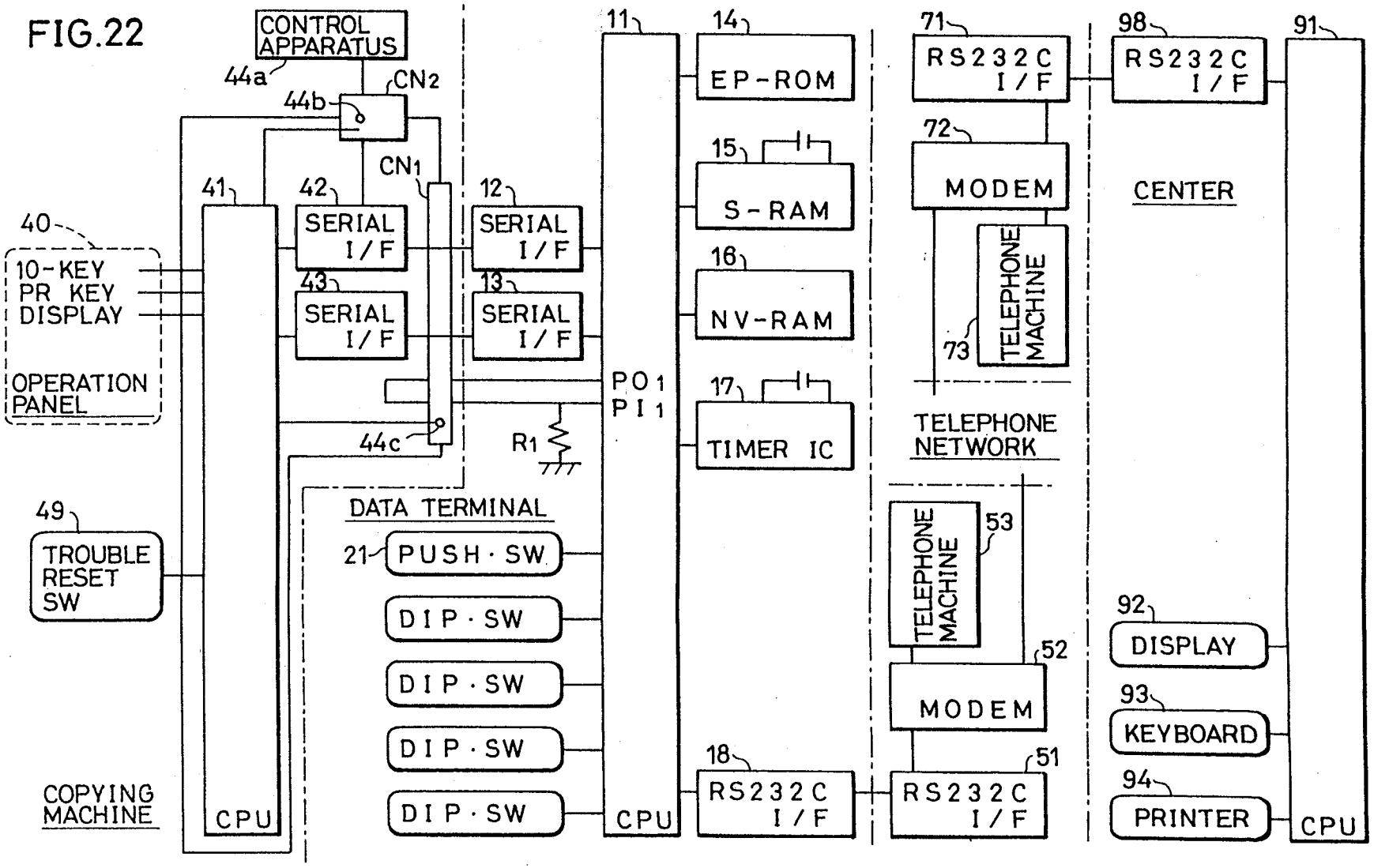
FIG. 22 is a block diagram showing a circuit configuration of a control system in accordance with the third embodiment of the present invention.

As shown in FIG. 22, controlling CPU 11 of the present data terminal 1 is connected to a ROM 14 in which a control program is stored, a nonvolatile memory 16 for storing selection number data (described later) and the like, a system RAM 15 for works backed up by a battery, and a timer IC17 similarly backed up by a battery.

CPU 11 takes in the data transmitted from copying machine 4 from serial I/F12 or serial I/F13, to perform processes described later. By this, the above-described functions are implemented. Output port PO1 and input port PI1 of CPU 11 are configured so that they short-circuit in the connector CN1 by the fact that serial I/F12 and serial I/F13 are connected to connector CNI. Accordingly, in the condition that serial I/F12 and serial I/F13 are connected to connector CNI, if the output port PO1 is drawn to a high level (Hi), the input port PI1 should be drawn to a high level (Hi). Utilizing this operation, connection and disconnection between serial I/F12 and serial I/F13, and connector CNI are detected (refer to the connector release transmission determination in FIG. 25).

Processes on Copying Machine Side

Figure 23:
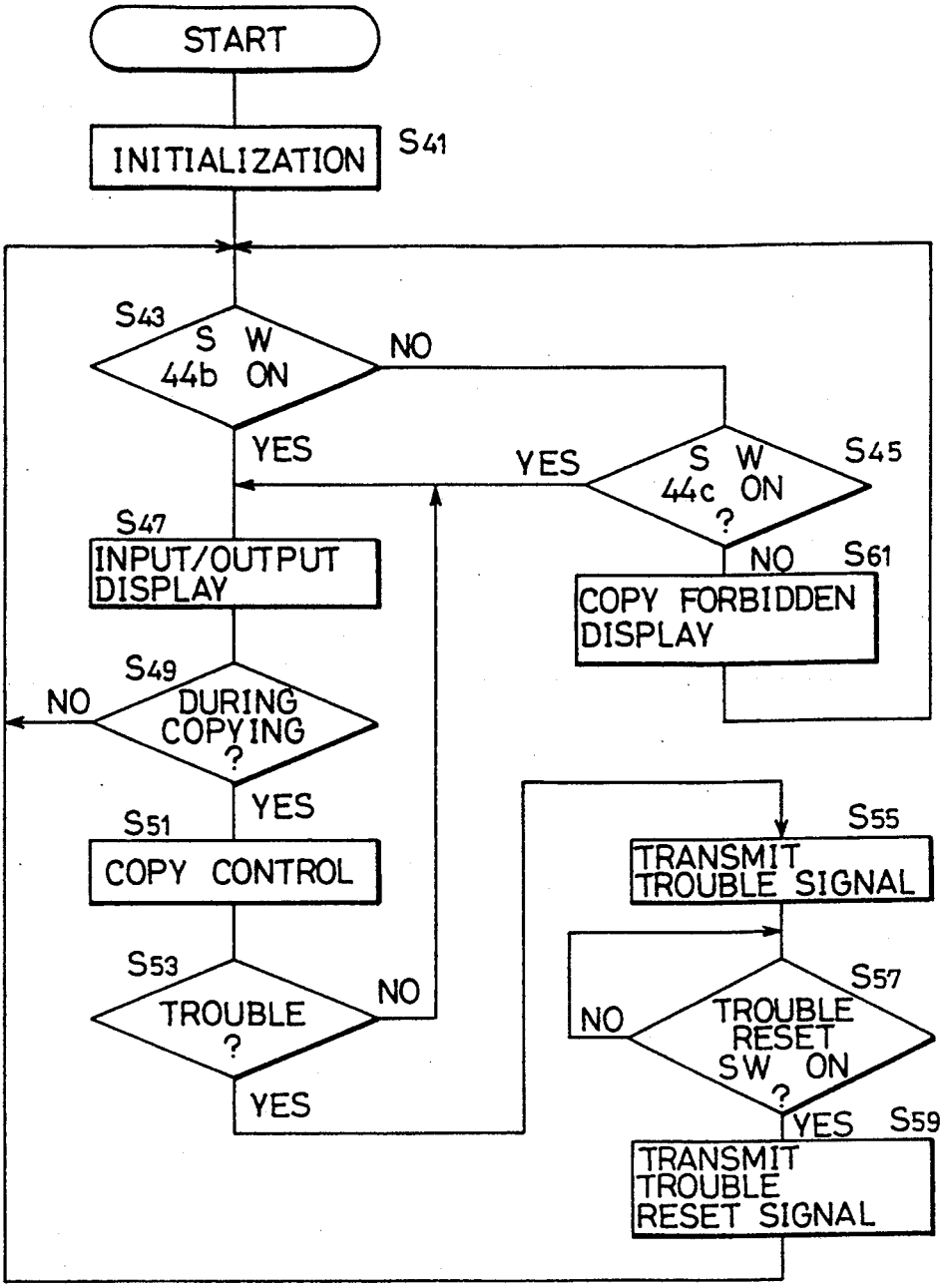
FIG. 23 is a flow chart showing control performed by the controlling CPU of the copying machine of FIG. 22.

First, the processes in controlling CPU 41 of a copying machine will be described referring to the flow chart of FIG. 23.

CPU 41 starts processing upon turn-on of a power supply to make initialization such as memory clear, standard mode setting, for example (S41). Subsequently, on the condition that microswitch 44*b* is ON (YES in S43), or that microswitch 44*c* is ON (YES in S45), the processes of steps S47–S53 are repeatedly performed. In other words, the processes in steps S47–S53 can be performed only when control apparatus 44*a* is connected to connector CN2 or the interface on the data terminal side is connected to connector CN1. When control apparatus 44*a* is not connected to connector CN2 (NO in S43), and also two interfaces on the data terminal side are not connected to connector CN1 (NO in S45), the copying operation is forbidden and also a message such as "copying is forbidden" or the like is made in display portion 44 (S61).

Step S47 is a process for taking in data from a group of key switches on operation panel 40 (a group of ten-key 47 for numerical input, a print (PR) key 46 for copy start command, a clear key 48 for set value clear command, etc.), the group of switches such as a trouble reset switch 49, and a group of sensors SE provided in a copying machine, and receipt data from the data terminal 1 side, and also it is a process for transmitting count data and so forth to data terminal 1.

Step S51 is a step collectively showing processes necessary in copying operation. For example, they include paper feed control, scanning control, photoreceptor drum control, developing device control.

The processes after step S55 are for trouble occurrence. That is, when JAM or other kinds of trouble occurs (YES in S53), a signal corresponding to the trouble occurred is transmitted to controlling CPU 11 of data terminal 1 (S55). When the trouble reset switch 49 is operated by an operator or the like (YES in S57), similarly to the description above, a trouble reset signal is transmitted to controlling CPU 11 of data terminal 1 (S59).

Processes on Data Terminal Side

* Connector Release Transmission Determination: S30

As will be described later in FIG. 25, this step is a routine for calling the center when connection between the interface on the data terminal side and connector CN1 is released.

* Connector Release Transmission Determination (FIG. 25)

This process is a subroutine for controlling the connector release transmission and the connector recovery transmission.

First, in the condition that a connector release flag is reset to "0" (YES in S701), an output of output port PO1 is brought to a high level (Hi) and a level of input port PI1 is examined (S713). As a result, when the output of PI1 is at the low level (Lo) (NO in S713), the connector release flag is set to "1", and a connector release transmission flag is set to "1" (S715). By this, the line communication process is implemented, and it is transmitted to the center that connection between the data terminal and the copying machine is released. This is because, as described above, if an output of input port PI1 is Lo in spite of the fact that an output of output port PO1 is made Hi, it can be regarded that connection between the data terminal and the connector CN1 is released.

Similarly, also when the connector release flag is set to "1" (NO in S701), an output of output port PO1 is made Hi (S721), and an output of input port PI1 is examined (S723), and when the output of PI1 returned to Hi (YES in S723), the connector release flag is reset to "0", and furthermore the connector recovery transmission flag is set to "1" (S725). By this, the line communication process is implemented and it is transmitted to the center that connection between the data terminal and the copying machine is recovered.

After the above determination and flag control performed as needed, an output of output port PO1 is returned to Lo (S717).

As described above, in the present process, when connection between the data terminal side and connector CN1 on the copying machine side is released, and also when the connection is recovered, the center side is called, respectively.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for collecting data related to a copying machine and communicating with a centralized control unit on the basis of the collected dam, comprising:

detecting means for detecting a trouble occurrence on the basis of data from said copying machine;

counting means for counting the number of times the trouble occurrence is detected by said detecting means;

calculating means for calculating a frequency of the trouble occurrence on the basis of the counted number of times of the trouble occurrence while said copying machine performs a predetermined number of copying processes;

receiving means for receiving a threshold value from said centralized control unit;

determining means for determining that said calculated trouble occurrence frequency exceeds said threshold value; and communication means for calling said centralized control unit in response to an output of said determining means.

2. The control apparatus according to claim 1, wherein said trouble occurrences comprises a paper jam.

3. The control apparatus according to claim 1, wherein the data from said copying machine includes data indicating a portion of said copying machine where said trouble occurrence is detected, and said counting means counts the number of times the trouble occurrence is detected for each portion of said copying machine.

4. The control apparatus according to claim 3, wherein said calculating means calculates a frequency of the trouble occurrence for each portion of said copying machine.

5. The control apparatus according to claim 4, wherein said determining means determines that the trouble occurrence frequency exceeds a predetermined value for each portion of said copying machine.

6. The control apparatus according to claim 5, wherein said communication means transmits to said centralized control unit warning data indicating a portion of said copying machine having a trouble occurrence frequency which exceeds the predetermined value.

7. A control apparatus for collecting data related to a copying machine and communicating with a centralized control unit on the basis of the collected data, comprising:

detecting means for detecting occurrence of a paper jam and a portion of the copying machine where said paper jam occurred on the basis of data from said copy machine;

counting means for counting a number of times of paper jam occurrence in response to an output of said detecting means for each portion of said copying machine;

calculating means for calculating an occurrence frequency of paper jams for each portion of said copying machine on the basis of the counted number of times of paper jams occurrence in each portion of said copying machine while said copying machine performs a predetermined number of copying processes;

receiving means for receiving a threshold value for each portion from said centralized control unit;

determining means for determining if an occurrence frequency at each portion of said copying machine calculated by said calculating means exceeds said threshold value for each portion of said copying machine; and communication means for calling said centralized control unit in response to an output of said determining means and for transmitting data including a portion of said copying machine having an occurrence frequency which exceeds said threshold value to said centralized control unit.

8. A control apparatus which collects data from a copying machine and communicates, based on the collected data, with a centralized control unit located at a remote site through a communication network comprising:

receiving means for receiving information from said copying machine;

first determination means, responsive to said information received by said receiving means, for determining an occurrence of a problem associated with said copying machine;

second determination means, responsive to said information received by said receiving means, for determining a recovery for the problem;

a communication device which is connected with said communication line to call said centralized control unit and to transmit a problem indication thereto; and controlling means for activating said communication device to call said centralized control unit when a problem is first determined by said first determination means and for forbidding said communication device to call the centralized control unit when the same problem is determined by said first determination means until said second determination determines the recovery for the problem.

9. A system including a copying machine and a control apparatus which collects data from said copying machine and communicates, based on the collected data, with a centralized control unit located at a remote site through a communication network comprising:

a communication device which is provided on said control apparatus to call said centralized control unit when a problem occurs in said copying machine;

determination means liar determining that connection with said centralized control unit cannot be made after a predetermined number of attempts;

an operation panel which is provided to said copying machine to allow an operational input;

a message display which is located on said operation panel to display a predetermined message indicating disconnection between said control apparatus and said centralized control unit in response to an output of said determination means; and means for changing said predetermined message based upon a location in said communication network at which said control apparatus and said centralized control unit are disconnected.

10. A control apparatus which collects data from a copying machine and communicates, based on the collected dam, with a centralized control unit located at a remote site through a communication line, the control apparatus comprising:

an interface through which data from said copying machine is received by said control apparatus and through which data is transmitted from said control apparatus to said copying machine;

a connector which connects said interface with said copying machine;

a communication device which is connected by said communication line to said centralized control unit; and determination means for determining whether said connector is properly connected with said interface and said copying machine; and means for activating said communication device in response to an output of said determination means.

* * * * *